US007200353B2

(12) United States Patent
Kitazawa et al.

(10) Patent No.: US 7,200,353 B2
(45) Date of Patent: Apr. 3, 2007

(54) IMAGE FORMING APPARATUS WITH INTERMEDIATE TRANSFER MEMBER

(75) Inventors: Atsunori Kitazawa, Nagano (JP); Masanori Nakata, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 223 days.

(21) Appl. No.: 10/929,355

(22) Filed: Aug. 30, 2004

(65) Prior Publication Data

US 2005/0078989 A1 Apr. 14, 2005

(30) Foreign Application Priority Data

| | | |
|---|---|---|
| Sep. 1, 2003 | (JP) | P2003-308928 |
| Sep. 1, 2003 | (JP) | P2003-308929 |
| Sep. 1, 2003 | (JP) | P2003-308930 |
| Oct. 17, 2003 | (JP) | P2003-357498 |
| Oct. 17, 2003 | (JP) | P2003-357499 |

(51) Int. Cl.
*G03G 15/01* (2006.01)

(52) U.S. Cl. ..... 399/302; 399/308

(58) Field of Classification Search ..... 399/38, 399/50, 53, 55, 66, 297, 298, 302, 308
See application file for complete search history.

(56) References Cited

U.S. PATENT DOCUMENTS 5,640,645 A * 6/1997 Namekata et al. ..... 399/66
6,985,681 B2 * 1/2006 Taguchi et al. ..... 399/66
6,990,298 B2 * 1/2006 Hamano et al. ..... 399/66

FOREIGN PATENT DOCUMENTS

| | | |
|---|---|---|
| JP | 3-64073 | 10/1991 |
| JP | 8-262841 | 10/1996 |
| JP | 2000-231276 | 8/2000 |
| JP | 2001-142280 | 5/2001 |
| JP | 2002-82533 | 3/2002 |
| JP | 2002-221879 | 8/2002 |

* cited by examiner

*Primary Examiner*—Hoan Tran
(74) *Attorney, Agent, or Firm*—Hogan & Hartson LLP

(57) ABSTRACT

An electrostatic latent image is formed on a rotary image carrier. A developing roller is separatably abutted on the image carrier to supply toner onto the image carrier to make the latent image visible as a toner image. An intermediate transfer member is adapted to temporarily hold the toner image. A first transferer presses the intermediate transfer member against the image carrier to define a primary transfer position therebetween, so that the toner image on the image carrier is transferred to the intermediate transfer member. A second transferer is separatably abutted on the intermediate transfer member to transfer the toner image on the intermediate transfer member to a recording medium. An operation for forming the latent image is started after a predetermined time period elapses since a toner attached on at least one of a first region of the intermediate transfer member, on which a toner image to be transferred onto the recording medium is not transferred, and a second region on the image carrier corresponding to the first region has passed through the primary transfer position.

19 Claims, 26 Drawing Sheets

IMAGE FORMING APPARATUS WITH INTERMEDIATE TRANSFER MEMBER

BACKGROUND OF THE INVENTION

The present invention relates to an image forming apparatus such as a copying machine, a printer, and a facsimile employing electrophotography and, more specifically, an image forming apparatus provided with an intermediate transfer member.

In the above-described image forming apparatus, a toner image primarily transferred from a latent image carrier such as a photosensitive drum to an intermediate transfer member such as an intermediate transfer belt is secondarily transferred to a recording medium such as paper. After then, toner remaining on the intermediate transfer member is removed by a cleaner such as a cleaning blade which comes into contact with the surface of the intermediate transfer member and scraping the residual toner from the intermediate transfer member.

FIG. 1A shows a state in which a cleaning blade 14 comes into contact with an intermediate transfer member 12 suspended by a driving roller 10 and a follower roller 11. As shown in FIG. 1C, toner T is accumulated on the extremity of the cleaning blade 14 by the amount corresponding to the thickness of the blade. From this state, as shown in FIG. 1B, when the cleaning blade 14 is separated from the intermediate transfer member 12, a toner line (separation line) 24 is generated. As shown in FIG. 1D, the width L of the toner line 24 is substantially equal to the thickness W of the cleaning blade 14.

Consequently, there arises a problem that the toner line 24 overlaps a toner image which is to be primarily transferred to the intermediate transfer member 12 in the subsequent image forming process. Japanese Patent Publication Nos. 2000-231276A and 2002-82533A teach that the separation timing of the cleaner is determined with reference to the position of the toner image to be primarily transferred to the intermediate transfer member 12, so as to prevent the toner line generated by the cleaner from overlapping the image area.

However, as shown in FIG. 2A, the toner line 24 formed in the above-described non-image area may attached to a secondary transfer roller 15 when the secondary transfer roller 15 comes into contact with the intermediate transfer member 12 immediately before the secondary transfer operation. Then, when the secondary transfer operation to a recording medium S is completed, and the secondary transfer roller 15 is separated from the intermediate transfer member 12 as shown in FIG. 2B, the toner line 24 is again attached on the intermediate transfer member 12.

FIG. 3A shows a state that a position C1 at which the toner line 24 is attached proceeds toward a primary transfer position T1 which is defined by an image carrier (photosensitive drum) 3 and a primary transfer roller 13. FIG. 3B shows a state that the toner line 24 reaches the primary transfer position T1, and an electrostatic latent image LI is formed by an exposure operation (i.e., light beam irradiation as indicated by an arrow). FIG. 3C shows a state that the latent image LI is developed by a developing roller 6*a* as a visible toner image TI.

The rotation velocity of the image carrier 3 changes when the image writing (exposure operation) is performed while the toner line 24 is at the primary transfer position T1 and the width L of the toner line 24 is no less than the nip width N of the primary transfer position as shown in FIG. 3D. Consequently, unevenness of density or color shifting due to the rotation velocity fluctuations of the image carrier 3, that is, so-called banding stain occurs. It results from the fact that when there exists the toner line 24 between the intermediate transfer member 12 and the image carrier 3, a friction force between them is lowered, so that the image carrier 3 slips and results in the rotation velocity fluctuations.

FIG. 4 shows experimental data obtained by measuring rotation velocity fluctuations of the image carrier 3. In this experiment, the circumferential velocity of the intermediate transfer member is set to a value faster than that of the circumferential velocity of the image carrier by 0.7%, and the toner images are transferred to the intermediate transfer member in the order of Bk (black), C (cyan), M(magenta), and Y(yellow).

In FIG. 4, the vertical axis represents rotation velocity fluctuations, the lateral axis represents time, and the rotation velocity fluctuation is obtained by subtracting the rotation velocity of the image carrier from the circulation velocity of the intermediate transfer member, and the result is then divided by the rotation velocity of the image carrier. Finally, the result is multiplied by 100 to obtain a percentage value. Accordingly, the "plus" value implies that the image carrier is slower than the intermediate transfer member, and the "minus" value implies that the image carrier is faster than the intermediate transfer member. The significant rotation velocity fluctuations appeared in the initial period are turbulence of an encoder signal occurred at the position corresponding to a seam of the intermediate transfer member (belt). The turbulences may be ignored because they are not actually the rotation velocity fluctuations. When the position of the toner line 24 on the intermediate transfer member 12 reaches the primary transfer position T1, distinctive rotation velocity fluctuations can be observed as shown by arrows A.

FIG. 5A shows experimental data in a case where the toner line formed on the intermediate transfer member is not removed. FIG. 5B shows experimental data in a case where the toner line formed on the intermediate transfer member is removed before it reaches the primary transfer position. From both results, it is apparent that the rotation velocity fluctuation pointed by an arrow is derived from the existence of the toner line.

The banding stain problem described above also occurs when the toner mark is attached to the area on the image carrier 3 corresponding to the non-image area on the intermediate transfer member 12. As shown in FIG. 6A, when the developing roller 6*a* comes into contact with a position C2 on the image carrier 3, a toner line (contact line) 24 is attached thereto due to the impact of the developing roller 6*a*. As shown in FIG. 6B, the toner line 24 then reaches the primary transfer position T1. As shown in FIG. 6C, the toner line 24 is partially transferred to the non-image area on the intermediate transfer member 12 and passed through the primary transfer position T1, while the electrostatic latent image LI is developed by the developing roller 6*a*.

Similarly, the rotation velocity of the image carrier 3 changes when the image writing (exposure operation) is performed while the toner line 24 is at the primary transfer position T1. Consequently, unevenness of density or color shifting due to the rotation velocity fluctuations of the image carrier 3, that is, so-called banding stain occurs. It results from the fact that when there exists the toner line (contact line) 24 between the intermediate transfer member 12 and the image carrier 3, a friction force between them is lowered, so that the image carrier 3 slips and results in the rotation velocity fluctuations.

In the experimental data shown in FIG. 7, the pressure fluctuations due to the contact line 24 can be observed at positions pointed by arrows B.

In such an image forming apparatus that an AC-superimposed bias is applied to a developing roller to develop an electrostatic latent image as a visible toner image, toner may locally attach to an image carrier by splashing or fogging of toner since the high voltage level of the bias cannot be stabilized at the initial stage of the application of the developing bias. In view of the above, Japanese Patent Publication No. 3-64073B teaches that an AC-superimposed bias is applied before the latent image on the image carrier reaches the developing position (that is, applied at a position corresponding to a non-image area) for stabilizing the bias before development, so that splashing or fogging of toner is prevented.

However, as shown in FIGS. 8A and 8B, when the AC-superimposed bias is applied to the position corresponding to the non-image area, toner in an area Y splashes on the image carrier 3 at the initial stage of bias application. Since the developing roller 6*a* and the image carrier 3 rotate in the direction indicated by arrows and a gap between the image carrier 3 and the developing roller 6*a* is increased, thereby weakening an electric field, the splashed toner cannot return to the developing roller 6*a*. Also, since the power source may become unstable at the initial stage of bias application, so-called overshoot may occur, and hence toner may splash to the image carrier 3. The toner line (bias application line) 24 is thus formed in the non-image area of the image carrier 3.

As shown in FIG. 9A, when the developing bias generated from a bias power source 25 is applied at a position C3 on the image carrier 3 via the developing roller 6*a*, the toner line 24 is attached due to the impact of the image carrier 3. As shown in FIG. 9B, the toner line 24 then reaches the primary transfer position T1. As shown in FIG. 9C, the toner line 24 is partially transferred to the non-image area on the intermediate transfer member 12 and passed through the primary transfer position T1, while the electrostatic latent image LI is developed by the developing roller 6*a*.

The rotation velocity of the image carrier 3 changes when the image writing (exposure operation) is performed while the toner line 24 on the position C3 is at the primary transfer position T1. Consequently, unevenness of density or color shifting due to the rotation velocity fluctuations of the image carrier 3, that is, so-called banding stain occurs. It results from the fact that when there exists the toner line (bias application line) 24 between the intermediate transfer member 12 and the image carrier 3, a friction force between them is lowered, so that the image carrier 3 slips and results in the rotation velocity fluctuations.

In the experimental data shown in FIG. 10, the pressure fluctuations due to the bias application line 24 can be observed at positions pointed by arrows C.

SUMMARY OF THE INVENTION

It is therefore an object of the invention to provide an image forming apparatus capable of preventing the appearance of banding stain even if the toner line is attached on the non-image area of the intermediate transfer member or a portion of the image carrier corresponding to the non-image area.

In order to achieve the above object, according to the invention, there is provided an image forming apparatus, comprising:

a rotary image carrier, on which an electrostatic latent image is formed;

a developer, comprising at least one developing roller which is separatably abutted on the image carrier to supply toner onto the image carrier to make the latent image visible as a toner image;

an intermediate transfer member, adapted to temporarily hold the toner image;

a first transferee, which presses the intermediate transfer member against the image carrier to define a primary transfer position therebetween, so that the toner image on the image carrier is transferred to the intermediate transfer member; and a second transferee, separatably abutted on the intermediate transfer member to transfer the toner image on the intermediate transfer member to a recording medium;

wherein an operation for forming the latent image is started after a predetermined time period elapses since a toner attached on at least one of a first region of the intermediate transfer member, on which a toner image to be transferred onto the recording medium is not transferred, and a second region on the image carrier corresponding to the first region has passed through the primary transfer position.

A circumferential velocity of the image carrier and a circumferential velocity of the intermediate transfer member may be different at the primary transfer position. Here, the image carrier and the intermediate transfer member may be driven by a common drive source.

The toner may be attached on the first region at least one of when the secondary transferer comes in contact with the intermediate transfer member and when the secondary transferer separates from the intermediate transfer member.

The toner may be attached on the second region at least one of when the developing roller comes in contact with the image carrier and when the developing roller separates from the image carrier.

In a case where a cleaner is separatably abutted on the intermediate transfer member to remove toner remaining thereon, the toner may be attached on the first region at least one of when the cleaner comes in contact with the intermediate transfer member and when the cleaner separates from the intermediate transfer member.

In a case where a cleaner is separatably abutted on the image carrier to remove toner remaining thereon, the toner may be attached on the second region at least one of when the cleaner comes in contact with the image carrier and when the cleaner separates from the image carrier.

In a case where a charger is separatably abutted on the image carrier to uniformly charge a surface of the image carrier before the latent image is formed, the toner may be attached on the second region at least one of when the charger comes in contact with the image carrier and when the charger separates from the image carrier.

With the above configurations, since the latent image formation is started after a toner line (separation toner line or contact toner line) passes through the primary transfer position, the image formation is not affected by the rotation velocity fluctuations of the image carrier due to the toner line, thereby avoiding the occurrence of the banding stain problem.

In a case where the cleaner is a blade member, and the first transferer applies a bias voltage to the intermediate transfer member, it is preferable that a nip width formed between the intermediate transfer member and the image carrier at the primary transfer position is larger than a thickness of the blade member.

It is further preferable that the nip width is two to fifth times of the thickness.

In a case where the cleaner is a brush member, and the first transferer applies a bias voltage to the intermediate transfer member, it is preferable that a nip width formed between the intermediate transfer member and the image carrier at the primary transfer position is larger than a circumferential length of a contact area between the brush member and the intermediate transfer member.

It is further preferable that the nip width is two to fifth times of the circumferential length.

With the above configurations, the rotation velocity fluctuations of the image carrier due to the toner line can be suppressed.

According to the invention, there is also an image forming apparatus, comprising:

a rotary image carrier, on which an electrostatic latent image is formed;

a developer, comprising at least one developing roller, through which a bias voltage is applied to supply toner onto the image carrier to make the latent image visible as a toner image;

an intermediate transfer member, adapted to temporarily hold the toner image; and a transferer, which presses the intermediate transfer member against the image carrier to define a primary transfer position therebetween, so that the toner image on the image carrier is transferred to the intermediate transfer member, wherein an operation for forming the latent image is started after a predetermined time period elapses since a portion on the image carrier to which the bias voltage is initially applied has passed through the primary transfer position.

A circumferential velocity of the image carrier and a circumferential velocity of the intermediate transfer member may be different at the primary transfer position. Here, the image carrier and the intermediate transfer member may be driven by a common drive source.

With the above configurations, since the latent image formation is started after a toner line (bias application toner line) passes through the primary transfer position, the image formation is not affected by the rotation velocity fluctuations of the image carrier due to the toner line, thereby avoiding the occurrence of the banding stain problem.

In a case where the cleaner is a blade member, and the transferer applies a bias voltage to the intermediate transfer member, it is preferable that a nip width formed between the intermediate transfer member and the image carrier at the primary transfer position is larger than a thickness of the blade member.

It is further preferable that the nip width is two to fifth times of the thickness.

In a case where the cleaner is a brush member, and the transferer applies a bias voltage to the intermediate transfer member, it is preferable that a nip width formed between the intermediate transfer member and the image carrier at the primary transfer position is larger than a circumferential length of a contact area between the brush member and the intermediate transfer member.

It is further preferable that the nip width is two to fifth times of the circumferential length.

With the above configurations, the rotation velocity fluctuations of the image carrier due to the toner line can be suppressed.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below in detail with reference to the accompanying drawings.

Figure 1A:
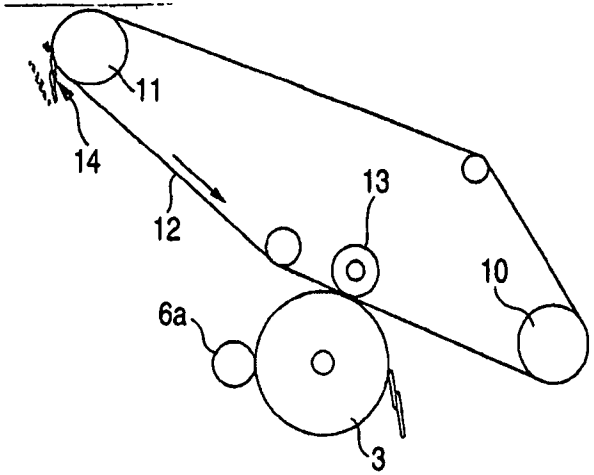
FIG. 1A Related Art
FIGS. 1A to 1D are schematic views for explaining formation of a toner line due to separation of an intermediate transfer belt cleaner in an image forming apparatus.
Figure 1B:
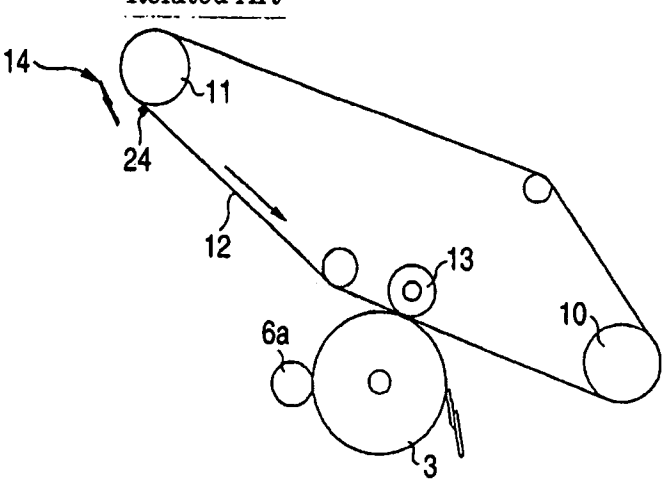
FIG. 1B Related Art
Figure 1C:
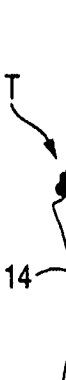
FIG. 1C Related Art
Figure 1D:
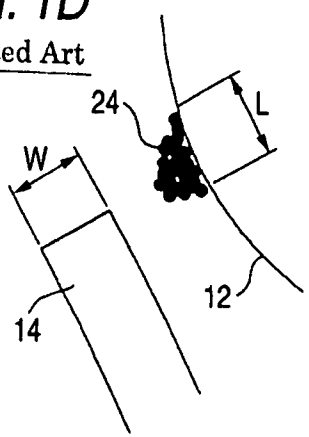
FIG. 1D Related Art
Figure 2B:
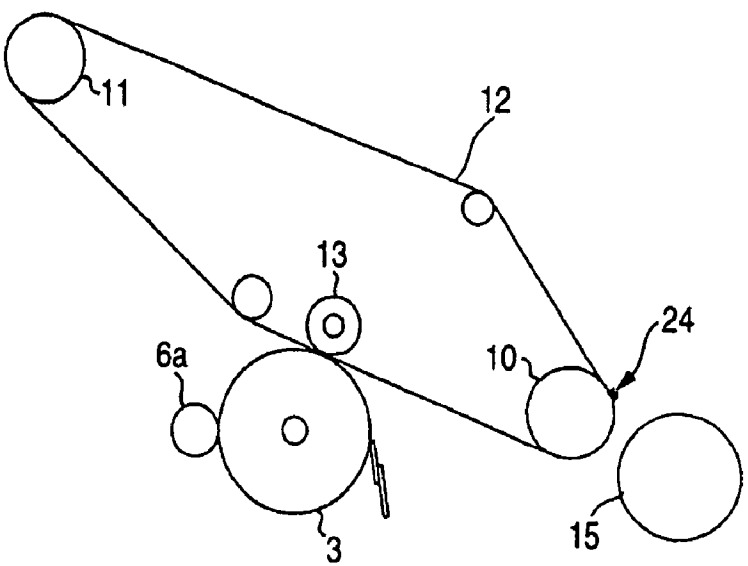
FIG. 2B Related Art
FIGS. 2A and 2B are schematic views for explaining formation of a toner line due to separation of a secondary transfer roller in an image forming apparatus.
Figure 2A:
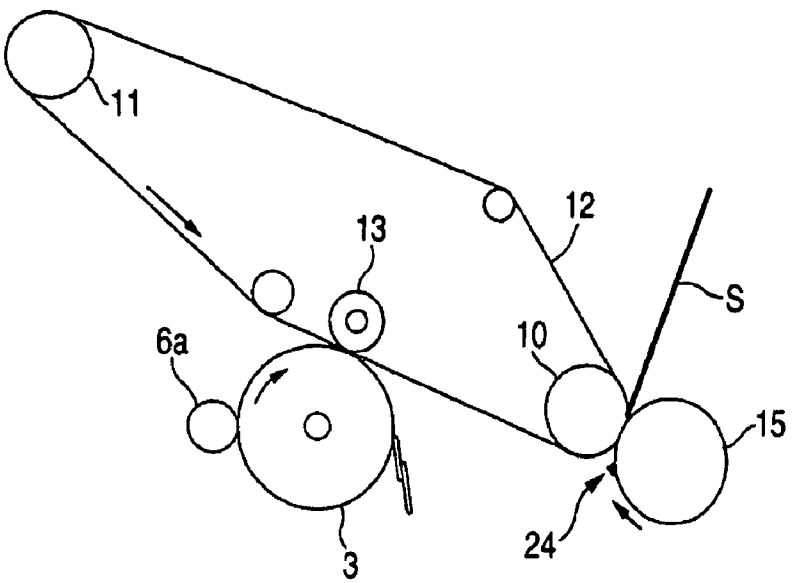
FIG. 2A Related Art
Figure 3A:
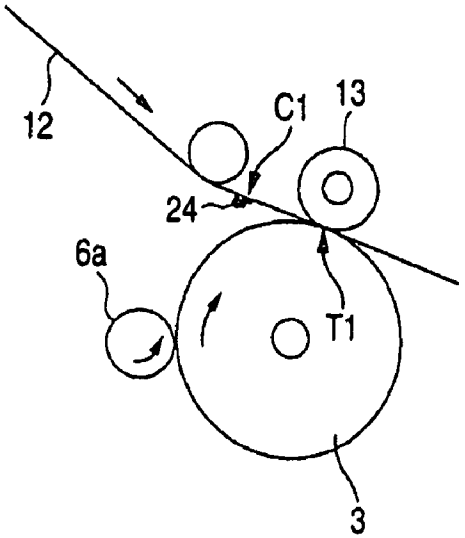
FIG. 3A Related Art
FIGS. 3A to 3D are schematic views for explaining rotation velocity fluctuation of an image carrier in an image forming apparatus due to the toner line formed by the separation of the intermediate transfer belt cleaner or the secondary transfer roller.
Figure 3B:
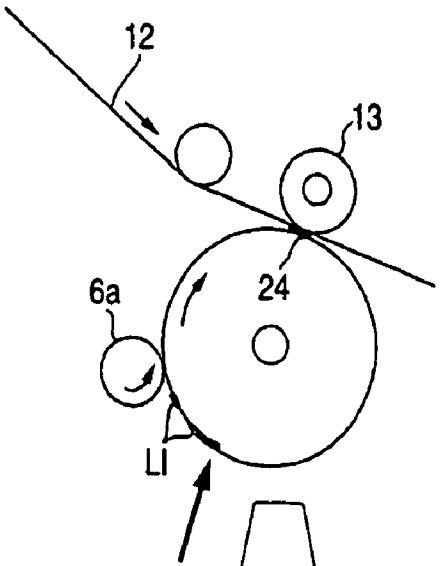
FIG. 3B Related Art
Figure 3C:
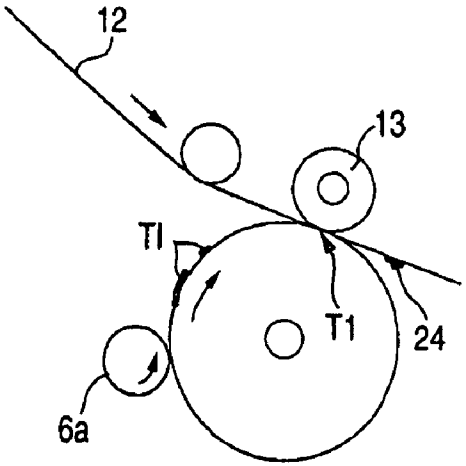
FIG. 3C Related Art
Figure 3D:
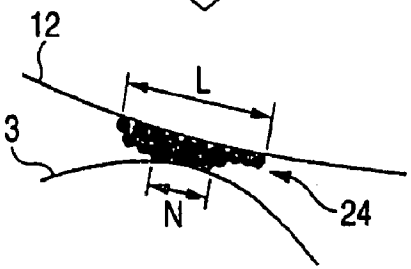
FIG. 3D Related Art
Figure 4:
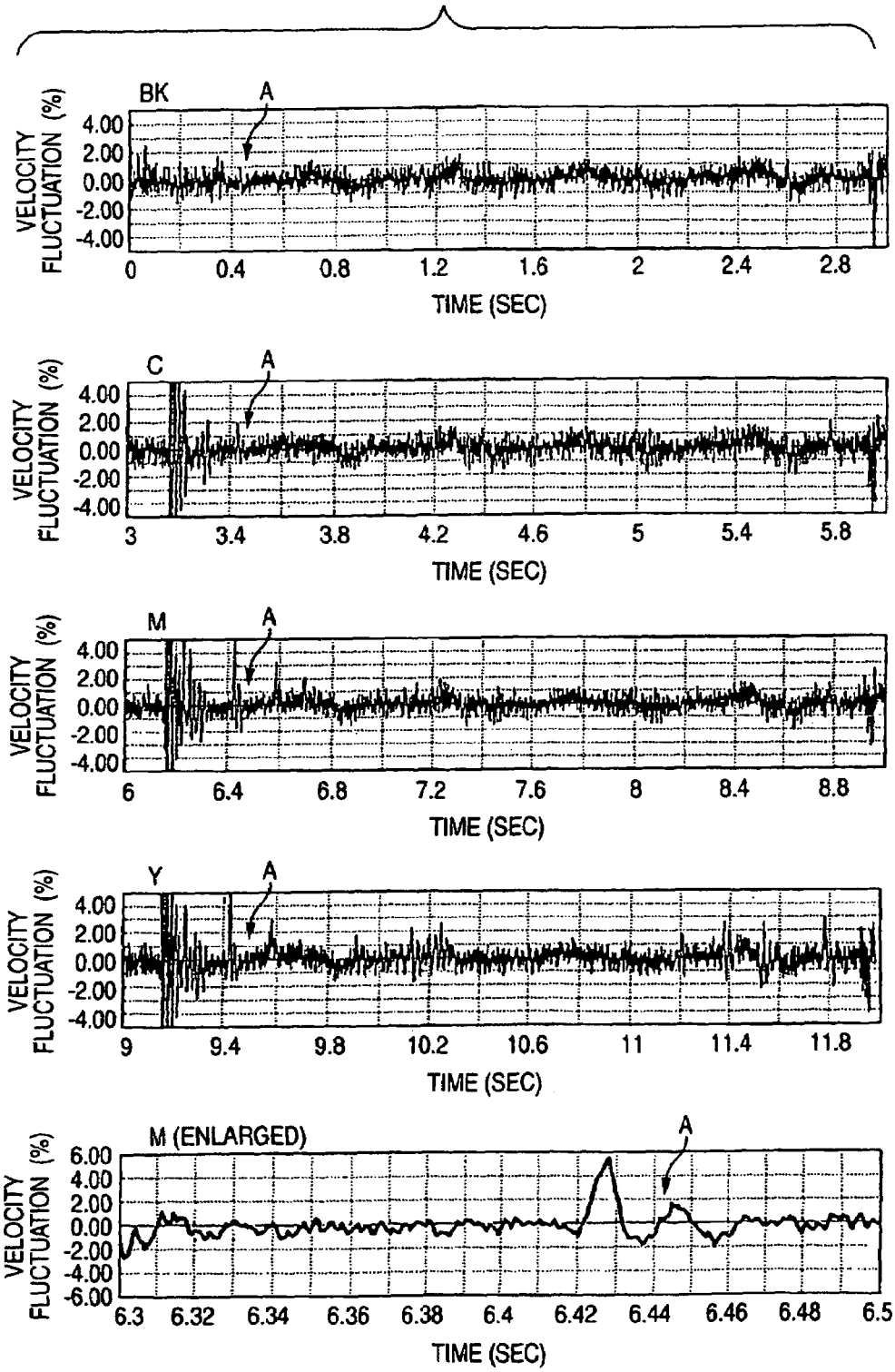
FIG. 4 Related Art
FIGS. 4 to 5B are experimental data for explaining the rotation velocity fluctuation due to the toner line formed by the separation of the intermediate transfer belt cleaner or the secondary transfer roller.
Figure 5A:
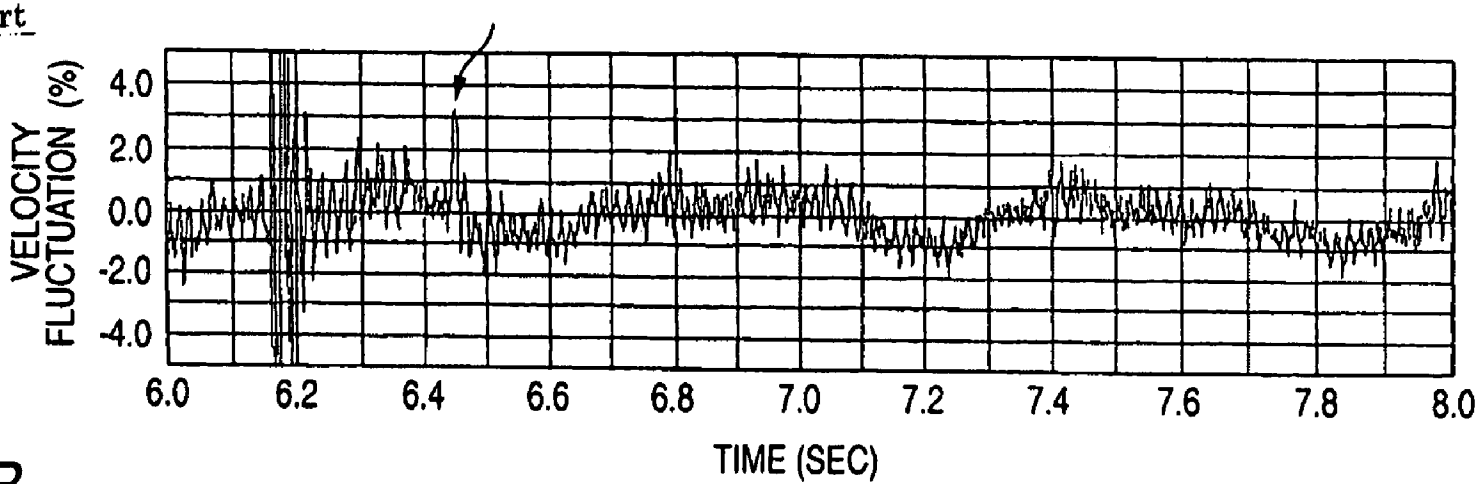
FIG. 5A Related Art
Figure 5B:
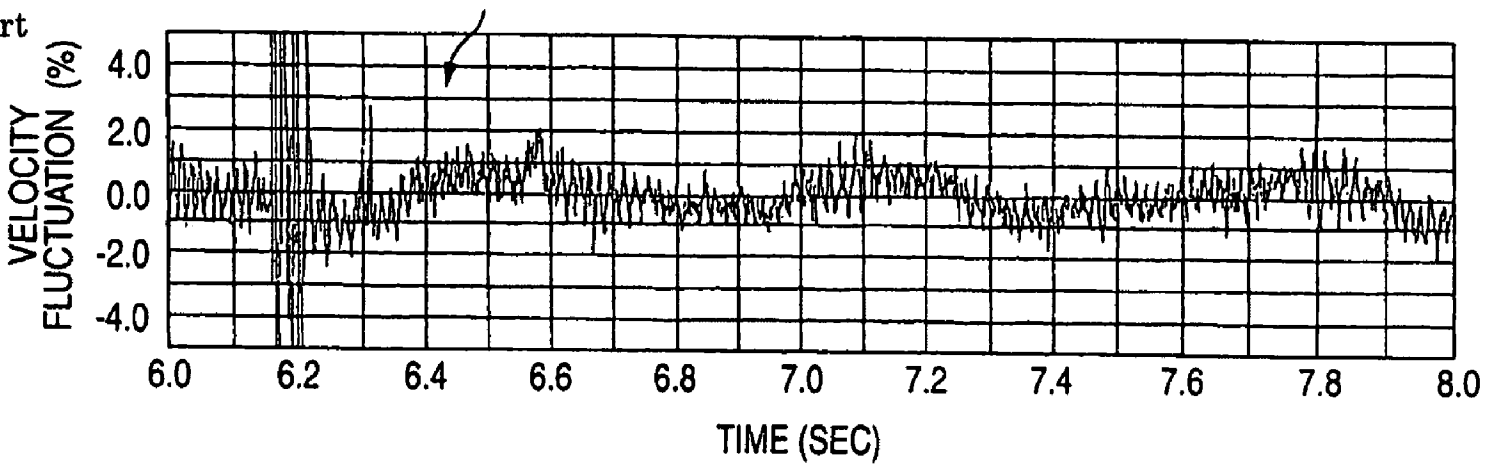
FIG. 5B Related Art
Figure 6A:
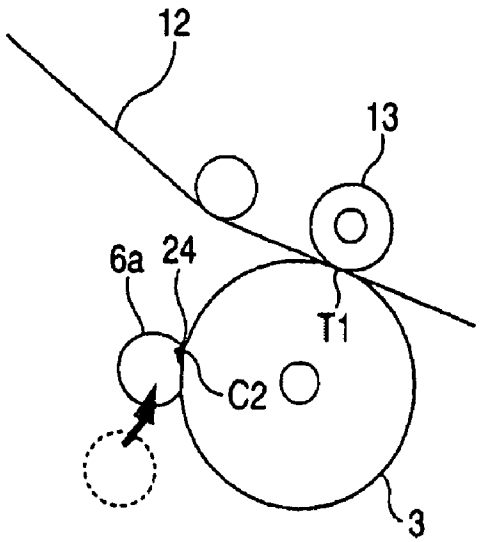
FIG. 6A Related Art
FIGS. 6A to 6C are schematic views for explaining formation of a toner line due to contact of a developing roller in an image forming apparatus.
Figure 6B:
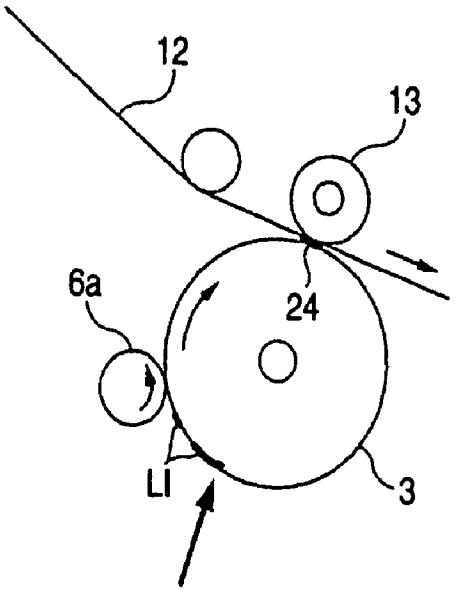
FIG. 6B Related Art
Figure 6C:
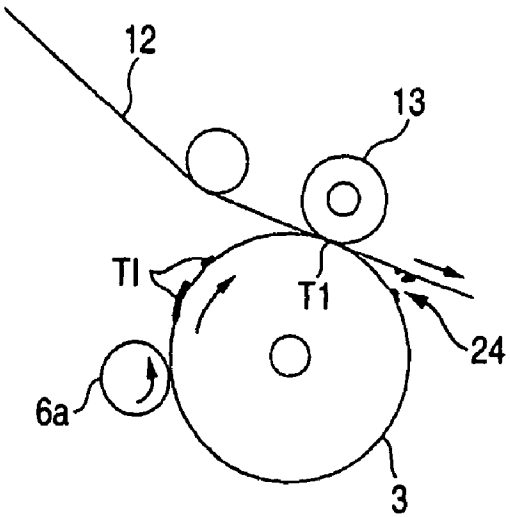
FIG. 6C Related Art
Figure 7:
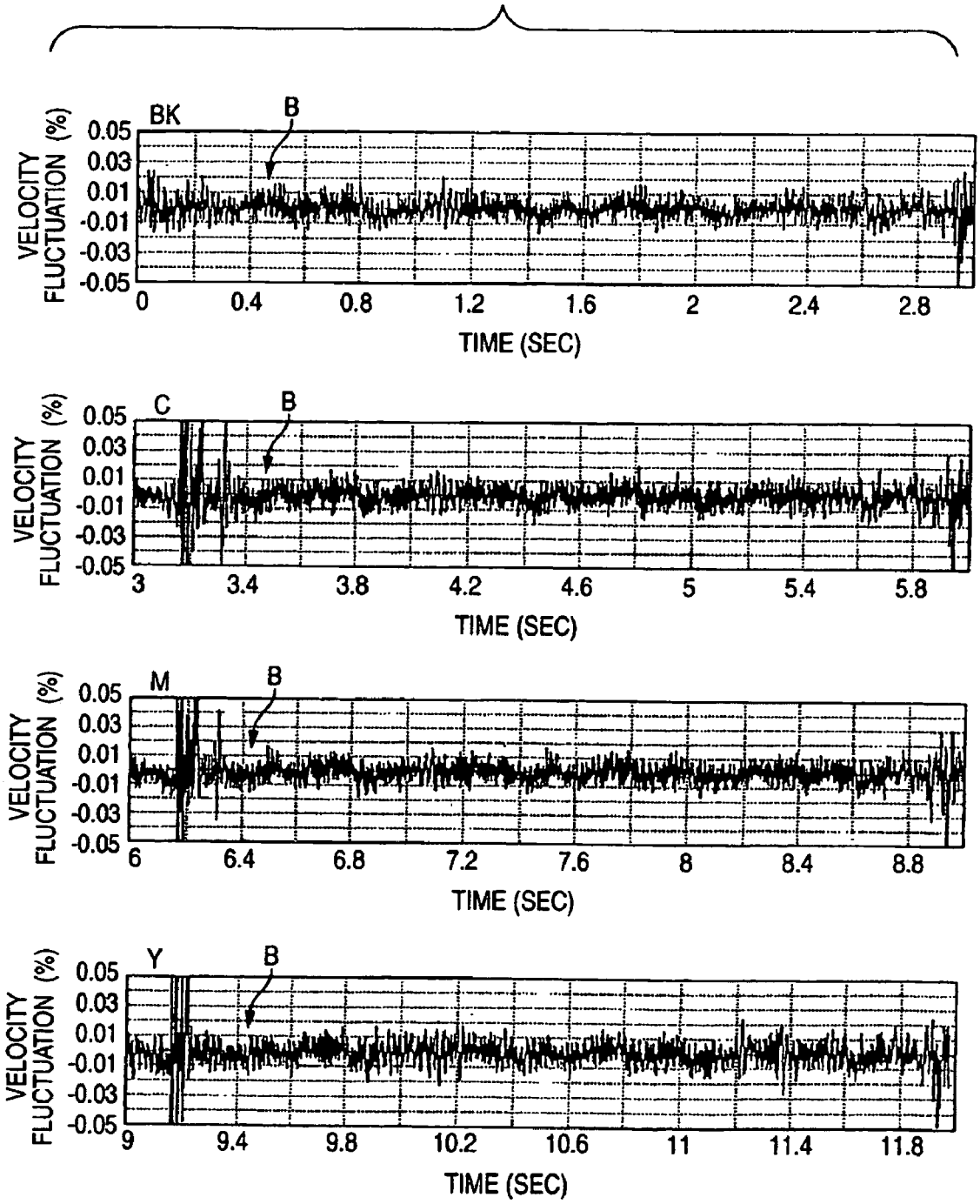
FIG. 7 Related Art
FIG. 7 is experimental data for explaining the rotation velocity fluctuation due to the toner line formed by the contact of the developing roller.
Figure 8B:
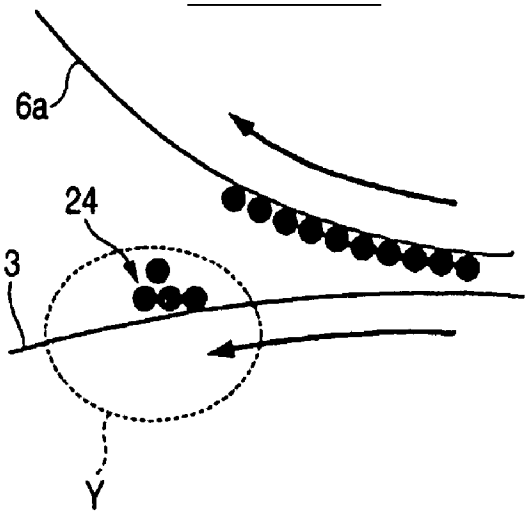
FIG. 8B Related Art
FIGS. 8A to 9C are schematic views for explaining formation of a toner line due to application of a developing bias in an image forming apparatus.
Figure 8A:
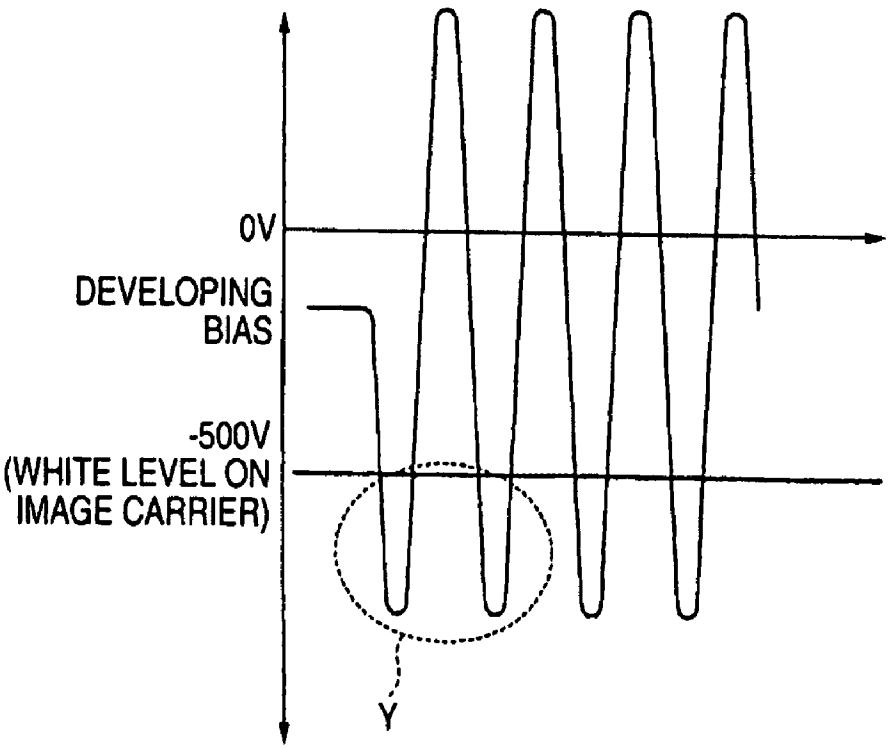
FIG. 8A Related Art
Figure 9A:
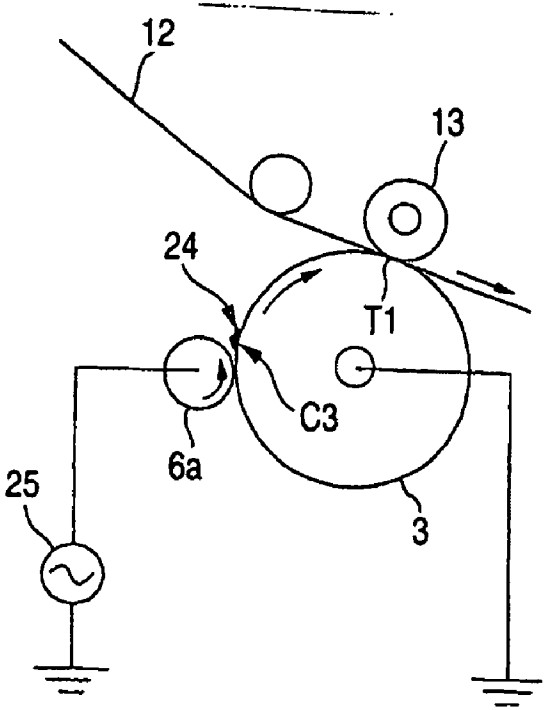
FIG. 9A Related Art
Figure 9B:
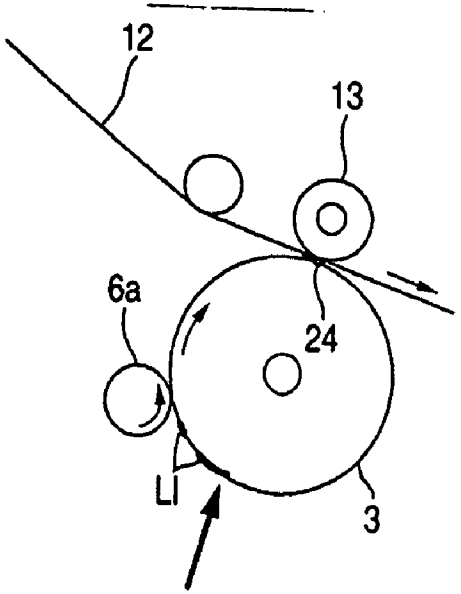
FIG. 9B Related Art
Figure 9C:
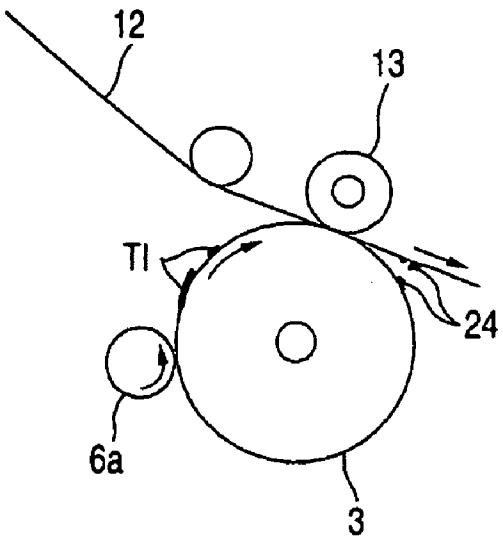
FIG. 9C Related Art
Figure 10:
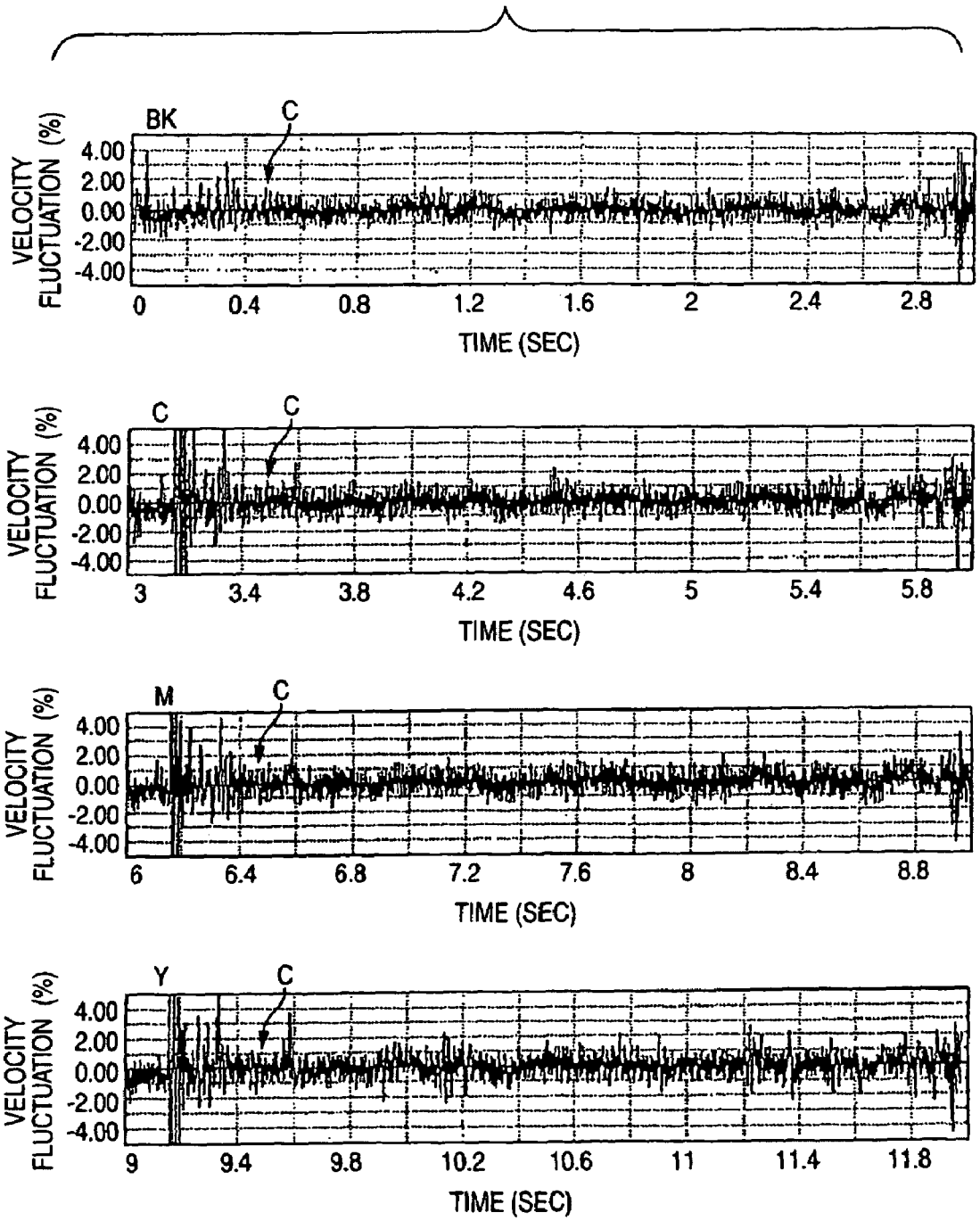
FIG. 10 Related Art
FIG. 10 is experimental data for explaining the rotation velocity fluctuation due to the toner line formed by the application of the developing bias.
Figure 11:
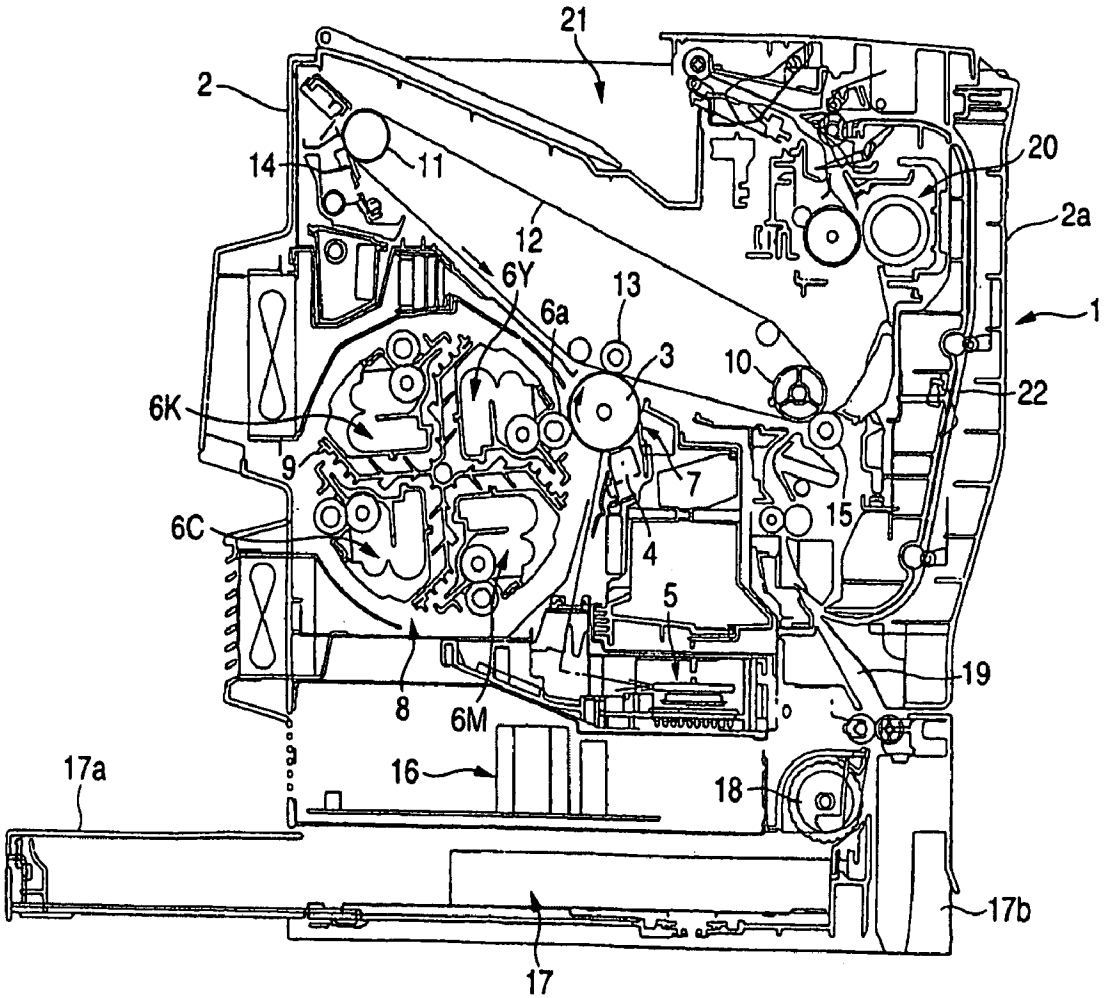
FIG. 11 is a schematic section view of an image forming apparatus according to a first embodiment of the invention.

As shown in FIG. 11, an image forming apparatus according to one embodiment of the invention comprises a body casing 2 provided with a sheet discharging tray 21 formed at the top portion thereof and a front door cover 2*a*. In the body casing 2, there are disposed a rotary development unit 8 in which plural toner cartridges 6C, 6M, 6Y, 6K are detachably mounted, a photosensitive drum 3 on which an electrostatic latent image is formed and a toner image is developed, an intermediate transfer unit onto which the toner image on the photosensitive drum 3 is transferred, a control unit to control respective driving motors and bias voltages, a power supply 16, a sheet feeding tray 17 containing recording media (e.g., sheets of paper), a fuser 20 to fix a toner image on a recording medium, etc. Also, inside the front cover 2*a* is provided a medium transporter 22 to transport a recording medium from the sheet feeding tray 17 to the fuser 20 through a secondary transfer roller 15. In addition, each unit is detachably provided in the main body, so that each unit is independently repaired or replaced during a maintenance work.

The photosensitive drum 3, serving as an image carrier, includes a conductive base material of a thin cylindrical shape, and a photosensitive layer formed on the surface thereof. Around the periphery of the photosensitive drum 3 are provided a charger 4 to uniformly charge the outer circumferential surface of the photosensitive drum 3, an exposer (or an image writer) 5 to form an electrostatic latent image on the photosensitive drum 3, the rotary development unit 8 to develop the electrostatic latent image, an intermediate transfer belt 12 onto which the toner image on the photosensitive drum 3 is primarily transferred, the intermediate transfer unit to perform primary transfer for the toner image to be transferred onto the intermediate transfer belt 12, a cleaner 7 to clean the surface of the photosensitive drum 3 after the primary transfer is performed.

The intermediate transfer unit comprises: a driving roller 10; a follower roller 11; the intermediate transfer belt 12, which is an endless belt stretched by these rollers 10 and 11 and is circulated in a direction indicated by an arrow in FIG. 11; a primary transfer roller 13, provided oppositely to the photosensitive drum 3 on the back side of the intermediate transfer belt 12, to perform primary transfer for the toner image on the photosensitive drum 3 to be transferred onto the intermediate belt 12; a belt cleaner (cleaning blade) 14 to remove residual toner on the intermediate transfer belt 12; and the secondary transfer roller 15, provided oppositely to the driving roller 10, to perform secondary transfer for a toner image formed on the intermediate transfer belt 12 to be transferred onto a recording medium (e.g., a sheet of paper).

The power supply 16 is provided below the exposer 5, and the sheet feeding tray 17 is provided at the bottom of the body casing 2. A recording medium in the sheet feeding tray 17 is transported to the sheet discharge tray 21 by way of a pick-up roller 18, a transportation path 19, the secondary transfer roller 15, and the fuser 20. A holder 17*b* is attached to the sheet feeding tray 17 so as to be pulled out forward from the apparatus, and in order to handle a sheet of paper of a larger size, an auxiliary tray 17*a*, protruding from behind the apparatus, is attached so as to be pulled out from the apparatus.

With the image forming apparatus 1 configured as described above, when an image forming signal is inputted into the exposer 5, the photosensitive drum 3, a developing roller 6*a* provided with each toner cartridge in the rotary development unit 8, and the intermediate transfer belt 12 are driven under the control of the control unit, and the outer circumferential surface of the photosensitive drum 3 is uniformly charged first by the charger 4. Subsequently, the surface of the photosensitive drum 3 is selectively exposed by the exposer 5 according to image information to form an electrostatic latent image.

In this instance, the rotary development unit 8 is rotated such that the developing roller 6*a* of the toner cartridge is brought into contact with the photosensitive drum 3. The electrostatic latent image is made visible as a toner image formed on the photosensitive drum 3. The toner image is transferred onto the intermediate transfer belt 12 by the primary transfer roller 13 to which a primary transfer voltage of a polarity opposite to a toner charging polarity is being applied. Toner remaining on the photosensitive drum 3 is then removed by the cleaner 7.

In a full-color image forming apparatus, toner cartridges 6Y, 6M, 6C, and 6K, respectively corresponding to yellow Y, magenta M, cyan C, and black K, are detachably mounted to the rotary development unit 8. During an image forming operation, the surface of the photosensitive drum 3 is selectively exposed by the exposer 5 according to image information of a first color, for example, yellow Y, to form an electrostatic latent image of yellow Y. In this instance, the rotary development unit 8 moves by rotation in such a manner that the developing roller 6*a* of the toner cartridge 6Y of yellow Y abuts on the photosensitive drum 3 for a toner image of the electrostatic latent image of yellow Y to be formed thereon. The toner image is subsequently transferred onto the intermediate transfer belt 12 by the primary transfer roller 13 to which the primary transfer voltage of a polarity opposite to a toner charting polarity is being applied.

During the foregoing operations, the belt cleaner 14 and the secondary transfer roller 15 are kept spaced apart from the intermediate transfer belt 12. By repetitively performing a series of these operations for image forming signals of a second color, a third color, and a fourth color, toner images of yellow Y, magenta M, cyan C, and black K corresponding to the contents of the respective image forming signals are transferred from the photosensitive drum 3 to be superposed sequentially on the intermediate transfer belt 12, and as a result, a full-color image of four colors is formed thereon. The color order of the development is arbitrary.

At a timing at which a full-color image in which the respective colors of toner images are superposed reaches the secondary transfer roller 15, a recording medium in the feed tray 17 is transferred from the pick-up roller 18 to the secondary transfer roller 15 via the transportation path 19, and the secondary transfer roller 15 is pressed against the intermediate transfer belt 12 while being applied with a secondary transfer voltage. The full-color toner image on the intermediate transfer belt 12 is thereby transferred onto the recording medium by the secondary transfer roller 15. When the recording medium, onto which the full-color toner image has been transferred in this manner, is transferred to the fuser 20 via the medium transporter 22, the toner image on the recording medium is heated and pressurized by the fuser 20 to be fixed thereon. Toner remaining on the intermediate transfer belt 12 is then removed by the belt cleaner 14.

In the case of double-sided printing, a recording medium coming out from the fuser 20 is switched back so that the rear end comes to the forefront, and is fed to the secondary transfer roller 15 again by way a double-sided printing transportation path in the medium transporter 22. A full-color toner image on the intermediate transfer belt 12 is then transferred onto the other side of the recording medium, and is fixed thereon through heating and pressuring by the fuser 20 again, after which the recording medium is discharged onto the sheet discharge tray 21.

In this embodiment, four toner cartridges 6Y, 6M, 6C, and 6K are mounted to the rotary development unit 8 to constitute a full-color image forming apparatus of four colors. However, the toner cartridge 6K for the toner of black K alone may be mounted to constitute a monochrome image forming apparatus, in which the toner cartridge 6K stands by at the stand-by position (home position), and when an image is formed, the toner cartridge 6K of black K moves by rotation from the stand-by position to the developing position to develop an electrostatic latent image on the photosensitive drum 3 into a toner image. This allows the use of the rotary development unit 8 of the same design specifications for both full-color and monochrome images. By using the common specifications for full-color and monochrome images, it is possible to remarkably save the maintenance, design, and manufacturing costs in comparison with a case where an image forming apparatus is designed separately for a full-color image and a monochrome image.

Figure 12:
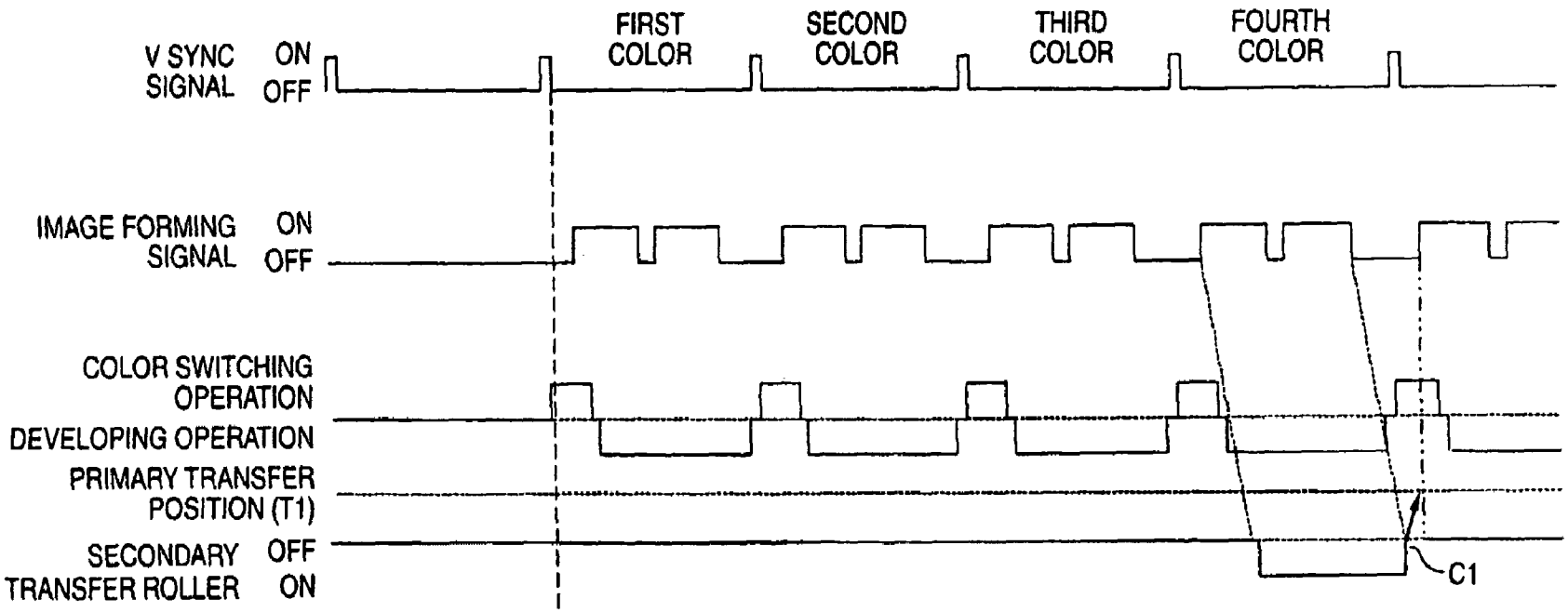
FIG. 12 is a diagram showing a control sequence performed in the image forming apparatus of FIG. 11.
Figure 13:
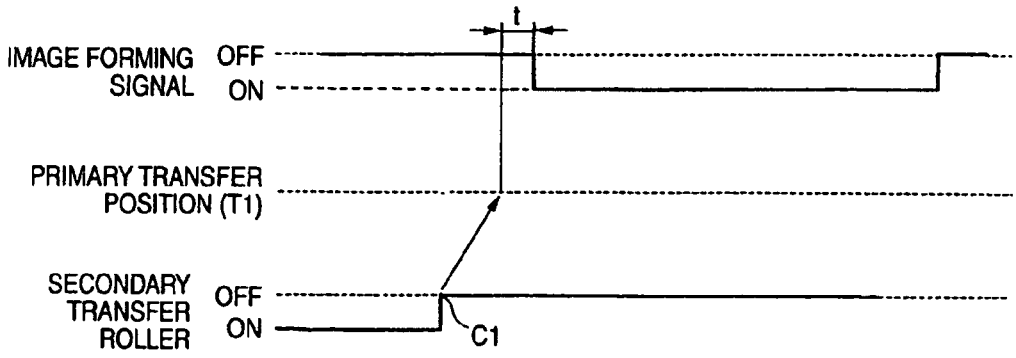
FIG. 13 is an enlarged diagram showing an essential portion of the control sequence of FIG. 12.
Figure 14:
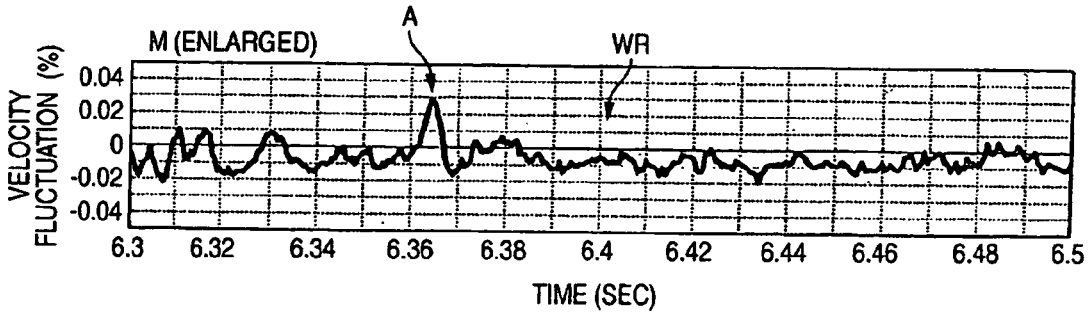
FIG. 14 is experimental data for explaining the control sequence of FIG. 12.

A control sequence according to a first embodiment of the invention will be described with reference to FIGS. 12 to 14.

The surface of the image carrier 3 is uniformly charged by the charger 4, the image signal is turned on synchronously with the vertical synchronizing (vsync) signal, selective exposure according to image information of a first color is performed on the surface of the image carrier 3 to form an electrostatic latent image. At this time, the rotary developing unit 8 rotates so that the developing roller 6*a* for the first color comes into contact with the image carrier 3, a toner image of the first color is formed on the image carrier 3 and transferred to the intermediate transfer member 12 by the primary transfer roller 13 on which a primary transfer voltage is applied.

Incidentally, the belt cleaner 14 and the secondary transfer roller 15 are separated from the intermediate transfer member 12. The image of four full colors is formed by the toner images according to the contents of the respective image forming signals being transferred and overlapped from the image carrier 3 to the intermediate transfer member 12 in sequence by performing the series of procedures repeatedly for a second color, a third color, and a fourth color of the image forming signal. Then, at a timing when the image formed by superimposing the toner images in the respective colors reaches the secondary transfer roller 15, the recording medium is carried to the secondary transfer roller 15, the secondary transfer roller 15 is pressed against the intermediate transfer belt 12, and the secondary transfer voltage is applied thereon so that the toner image on the intermediate transfer belt 12 is transferred to the recording medium by the secondary transfer roller 15.

When the secondary transfer operation is completed, the secondary transfer roller 15 is separated from the intermediate transfer member 12 and, at this moment, a toner line is attached to the intermediate transfer member 12. However, in this embodiment, as shown in detail in FIG. 12, the image signal for forming an electrostatic latent image is turned on after a predetermined time period t has elapsed after the position C1 on the intermediate transfer member 12, from which the secondary transfer roller 15 is separated, reaches the primary transfer position T1. Since the image is written (an arrow WR in FIG. 13) after the toner line 24 has passed through the primary transfer position T1 (an arrow A in FIG. 13), occurrence of the banding stain may be prevented without being affected by the rotation velocity fluctuations of the image carrier.

Figure 16:
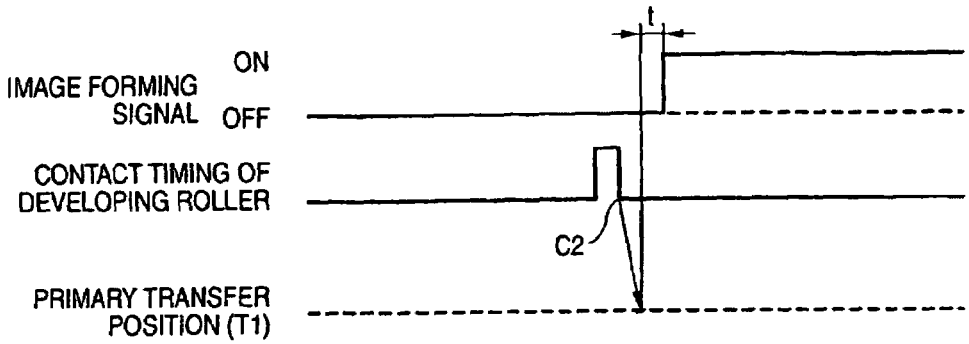
FIG. 16 is an enlarged diagram showing an essential portion of the control sequence of FIG. 15.
Figure 17:
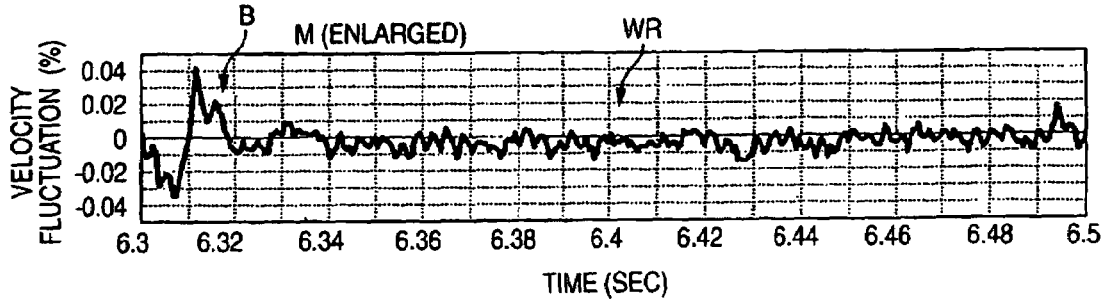
FIG. 17 is experimental data for explaining the control sequence of FIG. 15.

A control sequence according to a second embodiment of the invention will be described with reference to FIGS. 15 to 17.

Figure 15:
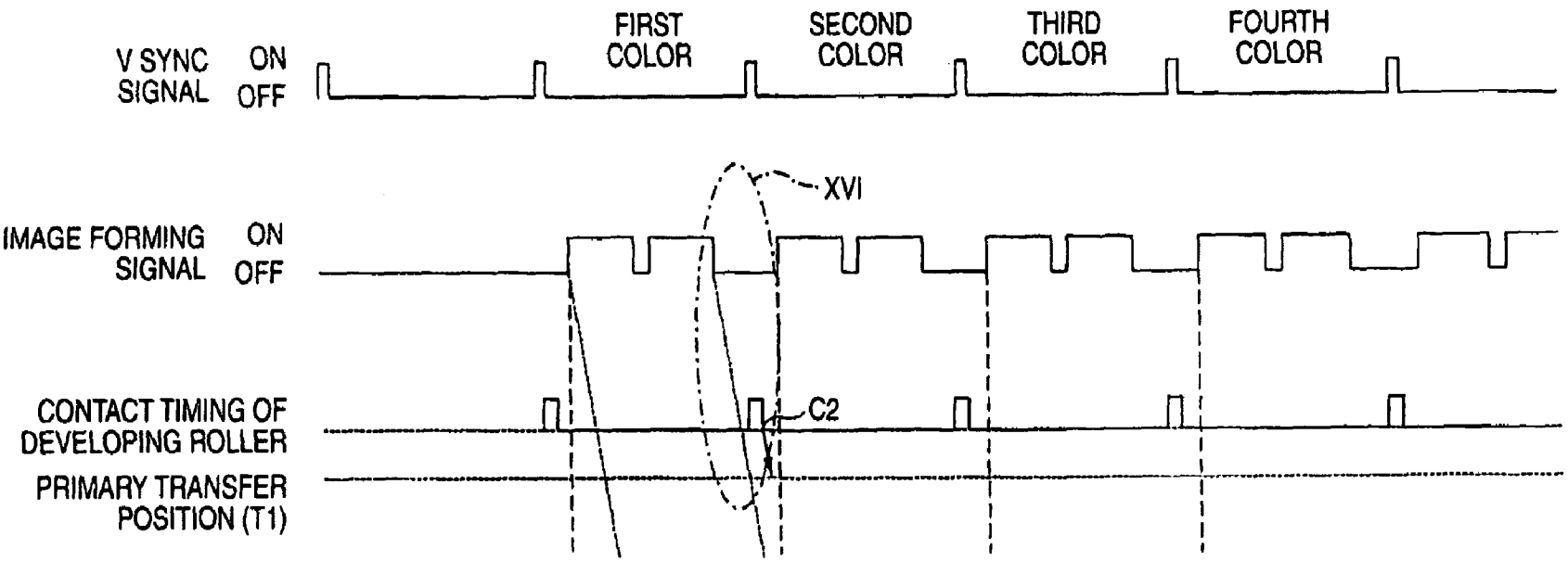
FIG. 15 is a diagram showing a control sequence performed in an image forming apparatus according to a second embodiment of the invention.

As shown in FIG. 15, the surface of the image carrier 3 is uniformly charged by the charger 4, the image signal is turned on synchronously with the vsync signal, selective exposure according to image information of the first color is performed on the surface of the image carrier 3 to form an electrostatic latent image. Incidentally, the rotary developing unit 8 rotates so that the developing roller 6*a* for the first color comes into contact with the image carrier 3, and the toner image of the first color is formed on the image carrier 3.

When the developing roller 6*a* comes in contact with the position C2 on the image carrier 3 corresponding to the non-image area on the intermediate transfer member 12, the toner line 24 is attached to the image carrier 3 due to the impact of the developing roller 6*a*. However, in this embodiment, as shown in detail in FIG. 16, the image signal for forming the electrostatic latent image is turned on after a predetermined time period t has elapsed after the position C2 where the developing roller 6*a* comes into contact with the image carrier 3 reaches the primary transfer portion T1. Since the image is written (an arrow WR in FIG. 17) after the toner line 24 has passed through the primary transfer position T1 (an arrow B in FIG. 17), occurrence of the banding stain may be prevented without being affected by the rotation velocity fluctuation of the image carrier.

Figure 19:
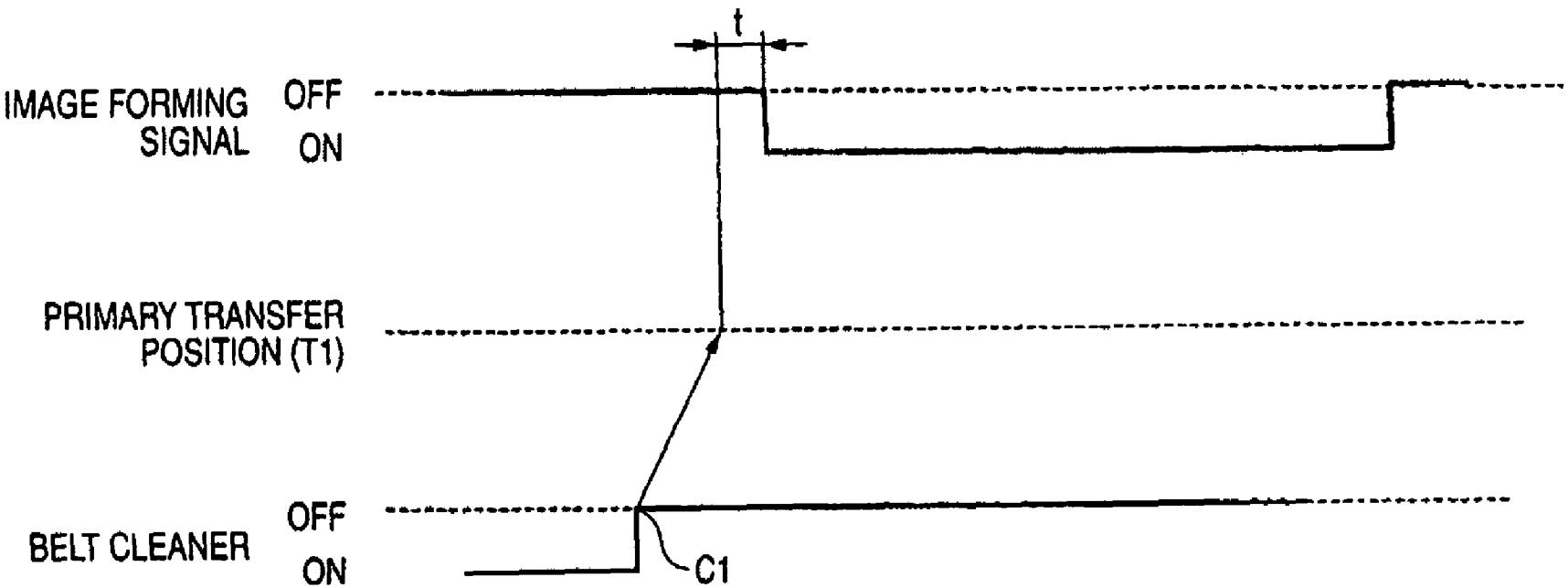
FIG. 19 is an enlarged diagram showing an essential portion of the control sequence of FIG. 18.
Figure 20:
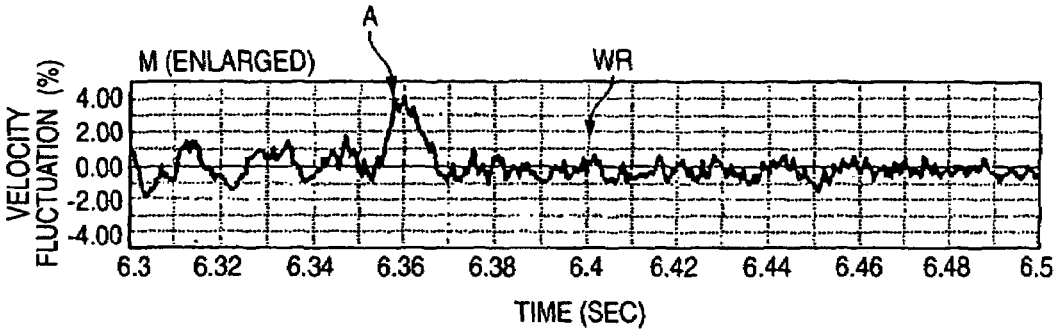
FIG. 20 is experimental data for explaining the control sequence of FIG. 18.

A control sequence according to a third embodiment of the invention will be described with reference to FIGS. 18 to 20.

Figure 18:
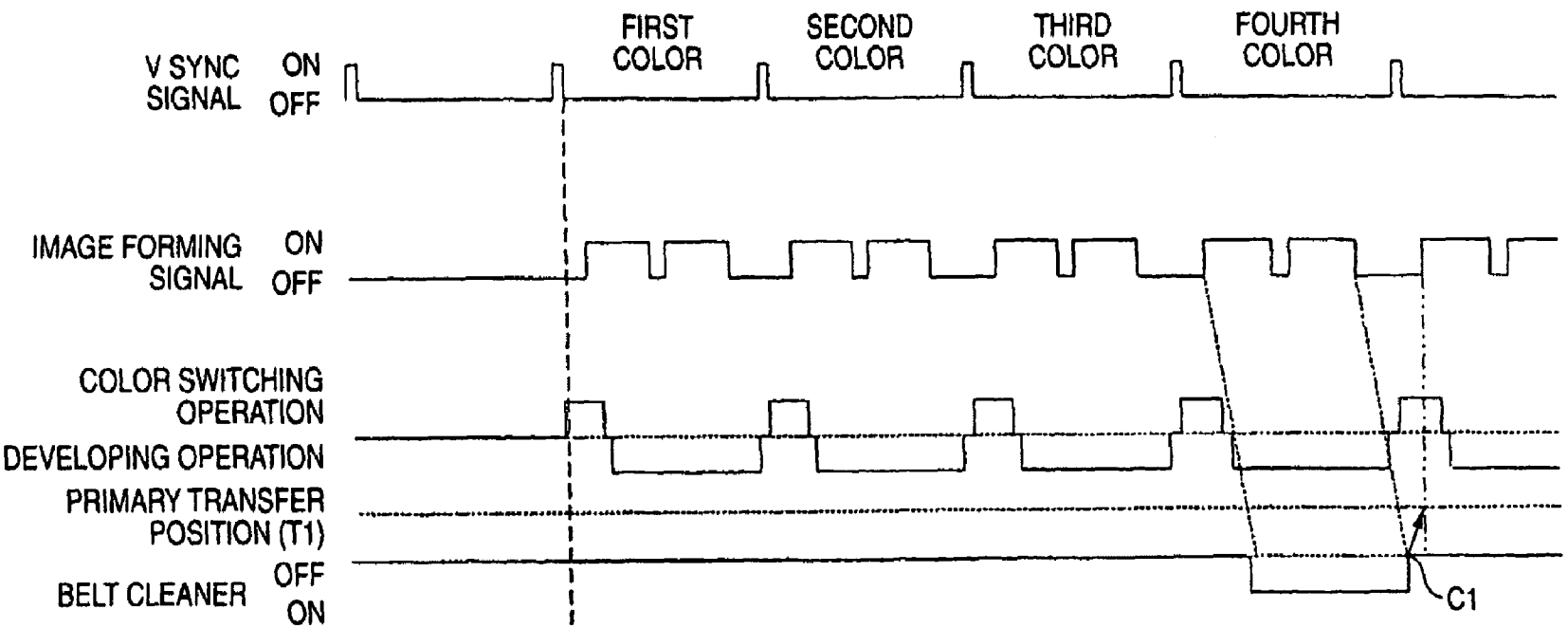
FIG. 18 is a diagram showing a control sequence performed in an image forming apparatus according to a third embodiment of the invention.

As shown in FIG. 18, the surface of the image carrier 3 is uniformly charged by the charger 4, the image signal is turned on synchronously with the vertical synchronizing (vsync) signal, selective exposure according to image information of a first color is performed on the surface of the image carrier 3 to form an electrostatic latent image. At this time, the rotary developing unit 8 rotates so that the developing roller 6*a* for the first color comes into contact with the image carrier 3, a toner image of the first color is formed on the image carrier 3 and transferred to the intermediate transfer member 12 by the primary transfer roller 13 on which a primary transfer voltage is applied.

Incidentally, the belt cleaner 14 and the secondary transfer roller 15 are separated from the intermediate transfer member 12. The image of four full colors is formed by the toner images according to the contents of the respective image forming signals being transferred and overlapped from the image carrier 3 to the intermediate transfer member 12 in sequence by performing the series of procedures repeatedly for a second color, a third color, and a fourth color of the image forming signal. Then, at a timing when the image formed by superimposing the toner images in the respective colors reaches the secondary transfer roller 15, the recording medium is carried to the secondary transfer roller 15, the secondary transfer roller 15 is pressed against the intermediate transfer belt 12, and the secondary transfer voltage is applied thereon so that the toner image on the intermediate transfer belt 12 is transferred to the recording medium by the secondary transfer roller 15.

Subsequently, toner remaining on the intermediate transfer belt 12 is removed by the belt cleaner 14. The belt cleaner 14 is separated from the intermediate transfer member 12 before the trailing edge of the image in the third color comes into contact with the intermediate transfer member 12 after having passed the contact position of the belt cleaner 14, and the leading edge of the image which corresponds to first color of the next image formed in the subsequent process reaches the contact position of the belt cleaner 14.

When the belt cleaner 14 is separated from the intermediate transfer member 12, the toner line 24 is generated. However, in this embodiment, as shown in detail in FIG. 19, the image signal for forming an electrostatic latent image is turned on after a predetermined time period t has elapsed after the position C1 on the intermediate transfer member 12, form which the belt cleaner 14 is separated, reaches the first transfer position T1. Since the image is written (an arrow WR in FIG. 20) after the toner line 24 has passed through the primary transfer position T1 (an arrow A in FIG. 20), occurrence of the banding stain may be prevented without being affected by the rotation velocity fluctuations of the image carrier 3.

The present invention is not limited to the aforementioned embodiments, and various modifications may be made. For example, although examples of separation of the second transfer roller 15, contact of the developing roller 6*a* and separation of the belt cleaner 14 have been described in the aforementioned embodiments, since the toner mark is generated by the contact of the secondary transfer roller 15 or the belt cleaner 14 and separation of the developing roller 6*a*, the invention may be applied to such cases. Furthermore, since attachment of toner mark to the image carrier 3 may be generated either in the case where the cleaner 7 comes into the image carrier 3 or separates therefrom, and in the case where a brush member serving as the charger 4 starts or stops driving, the present invention may be applicable to such cases as well.

In short, the image forming apparatus having a member which comes into and away from contact or a member which is driven or stopped in the non-image area on the intermediate transfer member 12 or in the area of the image carrier 3 corresponding thereto is characterized in that latent image is formed by the exposer 5 after the position corresponding to the downstream side of the position on the intermediate transfer member 12 which performs any one of the actions of separation, contact, drive or stop has passed through the primary transfer position T1.

A control sequence according to a fourth embodiment of the invention will be described with reference to FIGS. 21A to 22.

Figure 21A:
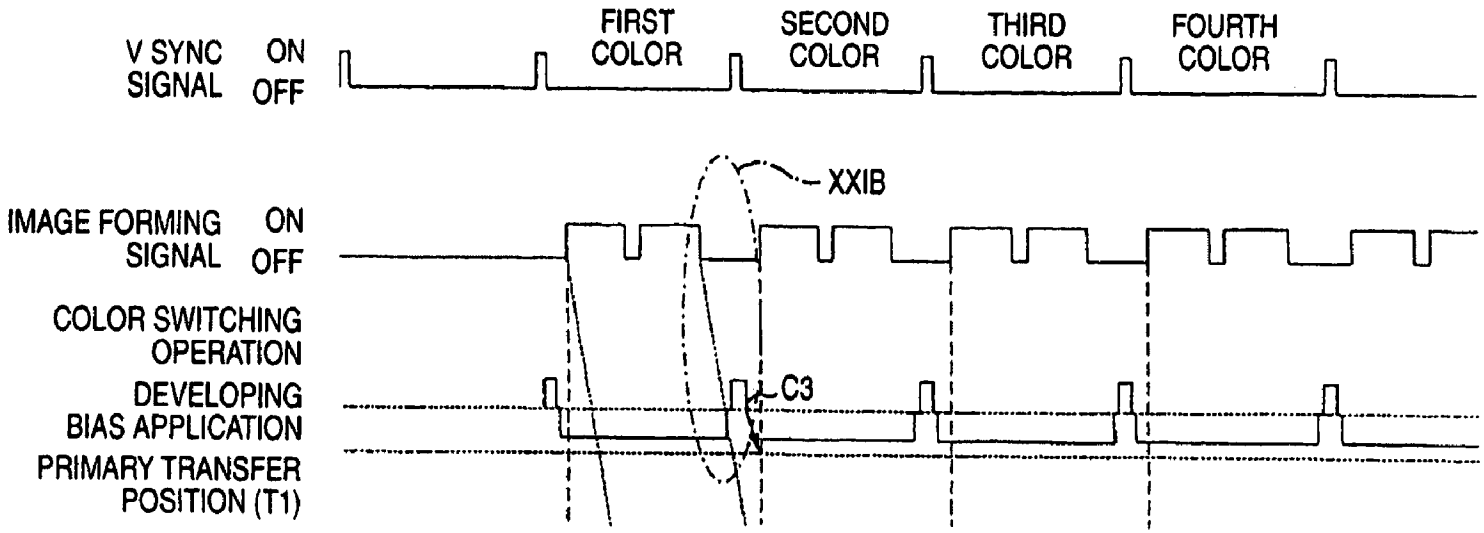
FIG. 21A is a diagram showing a control sequence performed in an image forming apparatus according to a fourth embodiment of the invention.
Figure 21B:
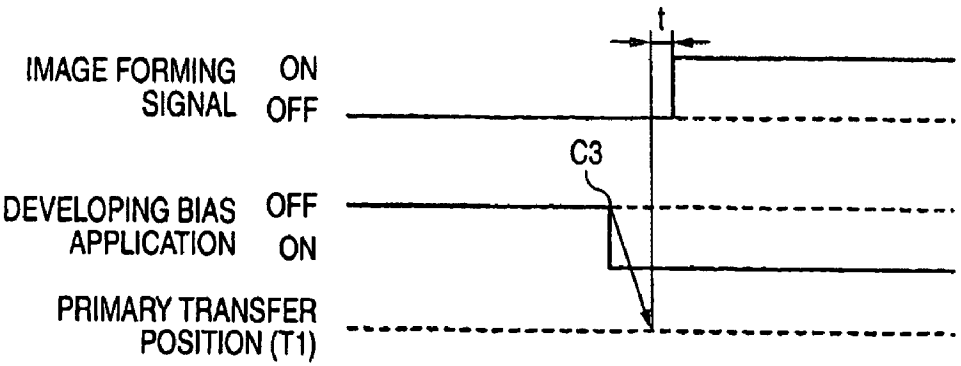
FIG. 21B is an enlarged diagram showing an essential portion of the control sequence of FIG. 21A.
Figure 22:
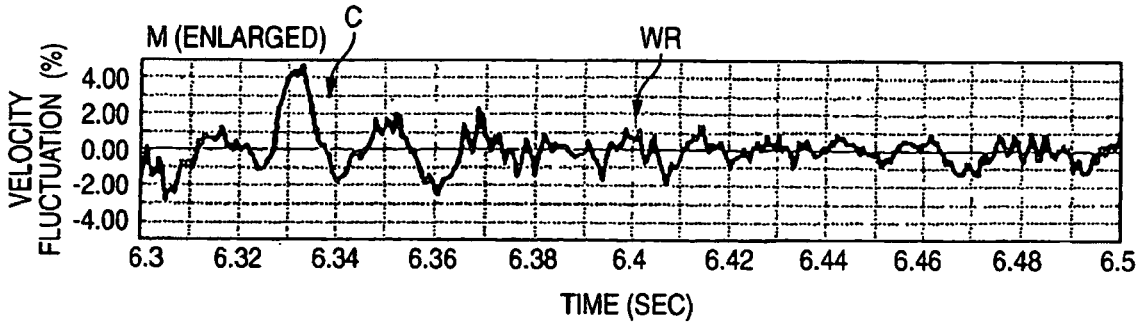
FIG. 22 is experimental data for explaining the control sequence of FIG. 21A.

As shown in FIG. 21A, the surface of the image carrier 3 is uniformly charged by the charger 4, the image signal is turned on synchronously with the vertical synchronizing (vsync) signal, selective exposure according to image information of a first color is performed on the surface of the image carrier 3 to form an electrostatic latent image. At this time, the rotary developing unit 8 rotates so that the developing roller 6*a* for the first color comes into contact with the image carrier 3. The AC-superimposed bias is applied to the developing roller 6*a* so that a toner image of the first color is formed on the image carrier 3 and transferred to the intermediate transfer member 12 by the primary transfer roller 13 on which a primary transfer voltage is applied.

When the developing bias is applied to the image carrier 3 through the developing roller 6*a*, the toner line 24 is generated. However, in this embodiment, as shown in detail in FIG. 21B, the image signal for forming an electrostatic latent image is turned on after a predetermined time period t has elapsed after the position C3 on the image carrier, to which the developing bias is applied, reaches the first transfer position T1. Since the image is written (an arrow WR in FIG. 22) after the toner line 24 has passed through the primary transfer position T1 (an arrow C in FIG. 22), occurrence of the banding stain may be prevented without being affected by the rotation velocity fluctuations of the image carrier 3.

Figure 23:
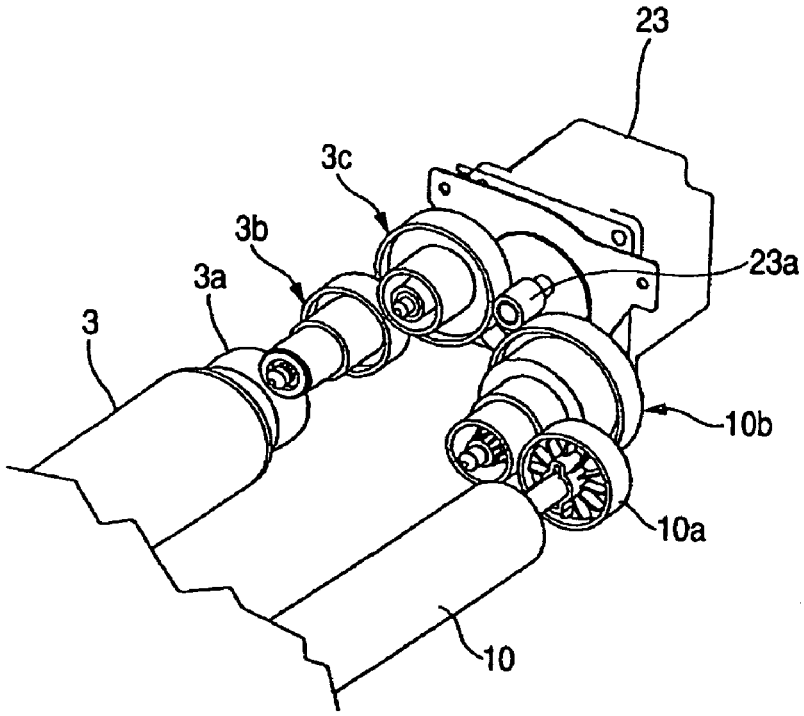
FIG. 23 is a perspective view of a mechanical structure for driving the image carrier and the intermediate transfer belt.

Next, a fifth embodiment of the invention will be described. FIG. 23 shows a drive system of the image carrier 3 and the intermediate transfer member 12. A drive gear 3*a* is connected to one end of the image carrier 3, and the drive gear 3*a* is connected to an output gear 23*a* of a drive motor 23 via transmission gears 3*b*, 3*c*. A drive gear 10*a* is connected to one end of the driving roller 10 for circulating the intermediate transfer member 12, and is connected to the output gear of the drive motor 23 via a transmission gear 10*b*.

Figure 24A:
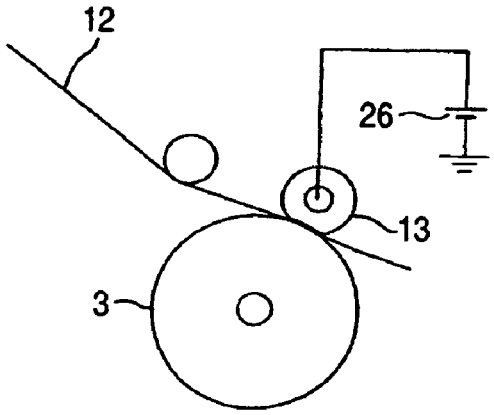
FIG. 24A is a schematic view showing a mechanism for applying a primary transfer bias.
Figure 24B:
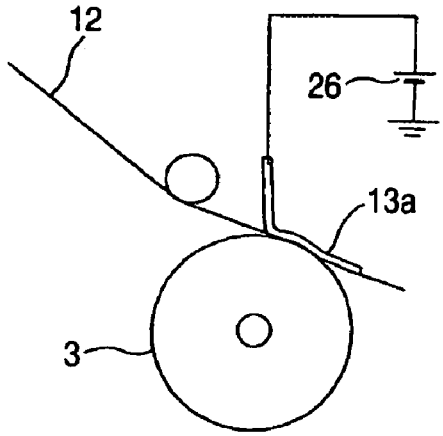
FIG. 24B is a schematic view showing a modified example of the mechanism for applying the primary transfer bias.

As shown in FIG. 24A, the primary transfer roller 13 is connected to a primary transfer power source 26. As shown in FIG. 24B, the primary transfer roller 13 may be substituted by a blade member 13*a*.

Figure 25:
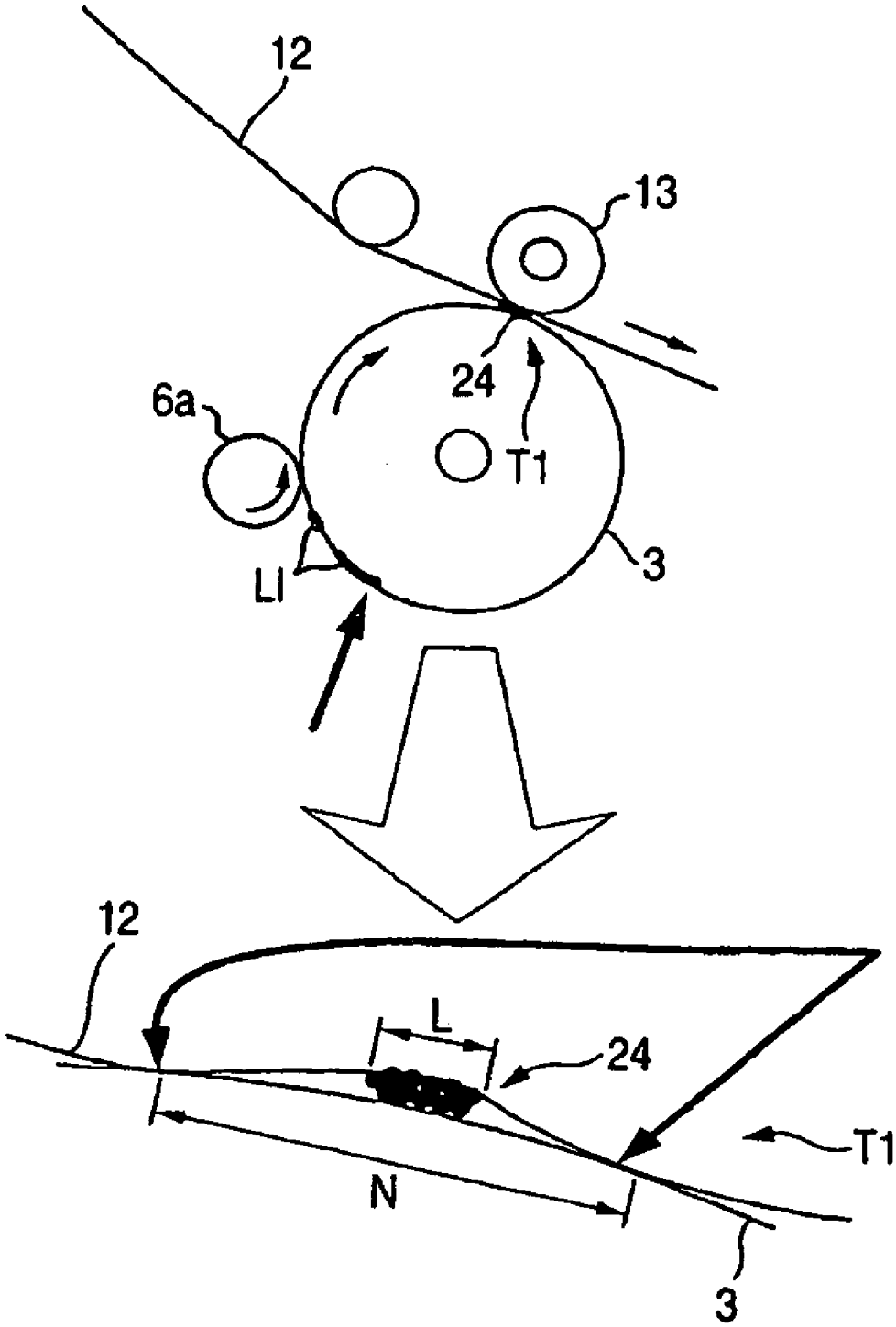
FIG. 25 is a schematic view of a primary transfer position in an image forming apparatus according to a fifth embodiment of the invention.

In this embodiment, as shown in FIG. 25, it is configured that the width L of the toner line 24 (the thickness W of the belt cleaner 14) is smaller than the width N of the primary transfer position T1. In a case where the toner line 24 exists between the intermediate transfer member 12 and the image carrier 3, the friction force between them suddenly reduces. However, in this embodiment, since there is a portion where no toner exists within the nip width N, the friction force can be maintained in the primary transfer position T1. On the other hand, as regards the portion having no toner, since the image carrier 3 and the intermediate transfer member 12 are in direct contact with each other, an electrostatic adsorptive force due to primary transfer bias increases. Therefore, the rotation velocity fluctuations of the image carrier 3 caused by slippage of the image carrier 3 can be reduced.

Similarly to the third embodiment, the image signal for forming an electrostatic latent image is turned on after a predetermined time period t has elapsed after the position C1 on the intermediate transfer member 12, form which the belt cleaner 14 is separated, reaches the first transfer position T1. Incidentally, since the nip width N at the primary transfer position T1 is made larger than the width L of the toner line 24 (the thickness W of the belt cleaner 14) and the primary transfer bias from the power source 26 is always applied, even when the toner line 24 passes through the primary transfer position T1, the friction force between the image carrier 3 and the intermediate transfer member 12 does not suddenly change, and hence the rotation velocity fluctuations of the image carrier 3 can be reduced.

If the rotation velocity fluctuations of the image carrier 3 can be sufficiently reduced, the image signal may be turned on while the toner line 24 passes the primary transfer position T1.

Figure 26:
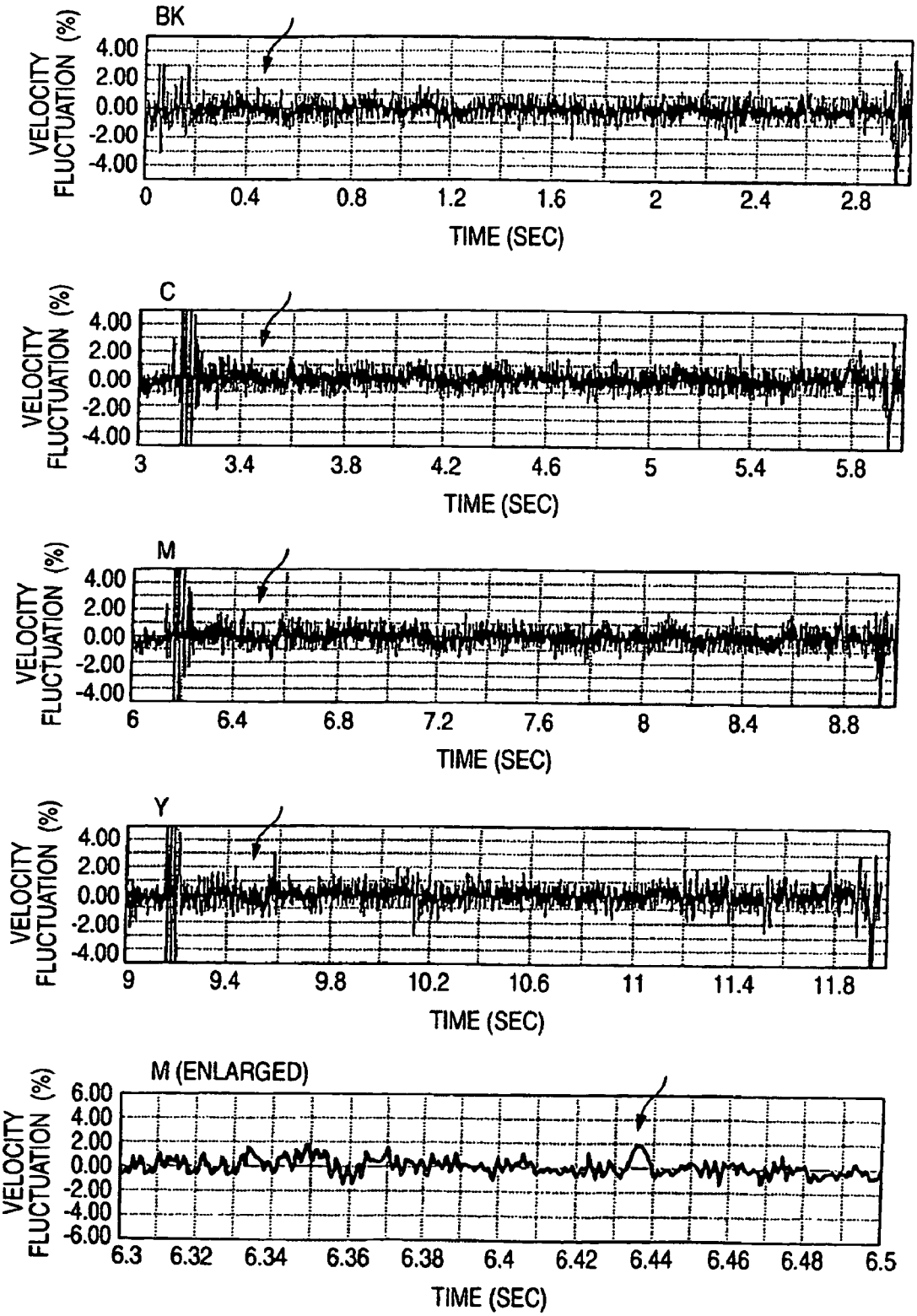
FIG. 26 is experimental data showing reduction of rotation velocity fluctuations by the image forming apparatus of FIG. 25.

FIG. 26 shows experimental data that the rotation velocity fluctuations of the image carrier 3 are observed under a condition that the nip width N at the primary transfer position T1 is made larger than twice of the thickness W of the belt cleaner 14. Arrows designate timings at which the toner line 24 passes through the primary transfer position T1. It is apparent that the rotation velocity fluctuation is suppressed at those timings.

Figure 27:
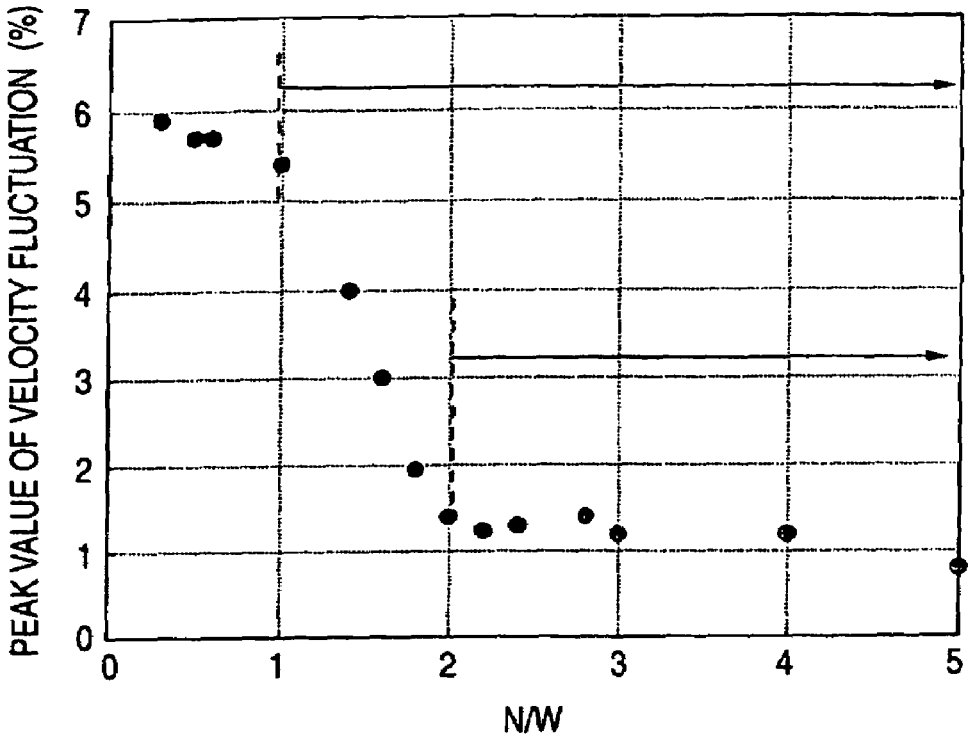
FIG. 27 is experimental data showing a proper range of a ratio of a nip width at a primary transfer position to a thickness of a belt cleaner in the image forming apparatus of FIG. 25.

FIG. 27 shows experimental data in which the lateral axis represents values of N/W and the vertical axis represents the peak values of rotation velocity fluctuations of the image carrier 3. The peak value is an average value of five peak values during the image forming operation for magenta. It is apparent that the rotation velocity fluctuation can be reduced in a rage of N/W between 2 and 5.

Figure 28:
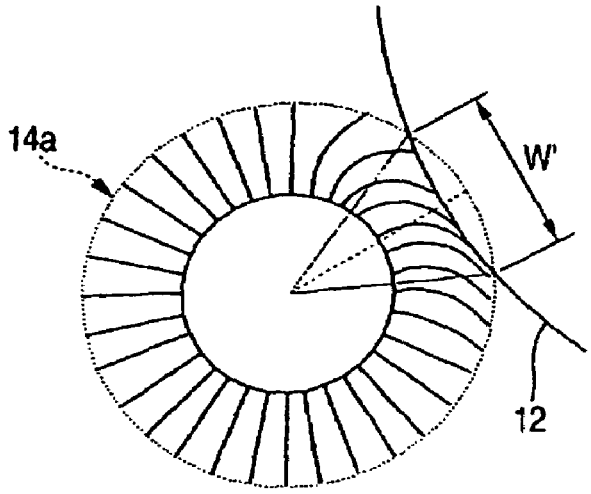
FIG. 28 is a schematic view of a belt cleaner in an image forming apparatus according to a sixth embodiment of the invention.

Next, a sixth embodiment of the invention will be described with reference to FIG. 28. In this embodiment, a cleaning brush 14*a* is used as the belt cleaner 14. In this case, the width L of the toner line 24 is coincident with the contact width W' of the cleaning brush 14*a*. The contact width W' is defined as a width of an area from a position that the tip ends of the cleaning brush 14*a* come in contact with the surface of the image carrier 3 to a position that the tip ends separate from the surface. Also in this case, the rotation velocity fluctuation can be reduced in a rage of N/W' between 2 and 5.

Next, a seventh embodiment of the invention will be described. As is explained with reference to FIG. 23, the image carrier 3 and the intermediate transfer member 12 are driven by the common drive motor 23 via the gear trains respectively. With this structure, in this embodiment, the circumferential velocities of the image carrier 3 and the intermediate transfer member 12 are substantially equalized at the primary transfer position T1. However, the image carrier 3 and the intermediate transfer member 12 are driven by individual motors only if the circumferential velocities of the image carrier 3 and the intermediate transfer member 12 are substantially equalized.

Similarly to the third embodiment, the image signal for forming an electrostatic latent image is turned on after a predetermined time period t has elapsed after the position C1 on the intermediate transfer member 12, form which the belt cleaner 14 is separated, reaches the first transfer position T1. Incidentally, since the nip width N at the primary transfer position T1 is made larger than the width L of the toner line 24 (the thickness W of the belt cleaner 14) and the circumferential velocities of the image carrier 3 and the intermediate transfer member 12 are substantially equalized at the primary transfer position T1, even when the toner line 24 passes through the primary transfer position T1, the friction force between the image carrier 3 and the intermediate transfer member 12 does not suddenly change, and hence the rotation velocity fluctuations of the image carrier 3 can be reduced.

If the rotation velocity fluctuations of the image carrier 3 can be sufficiently reduced, the image signal may be turned on while the toner line 24 passes the primary transfer position T1.

Figure 29:
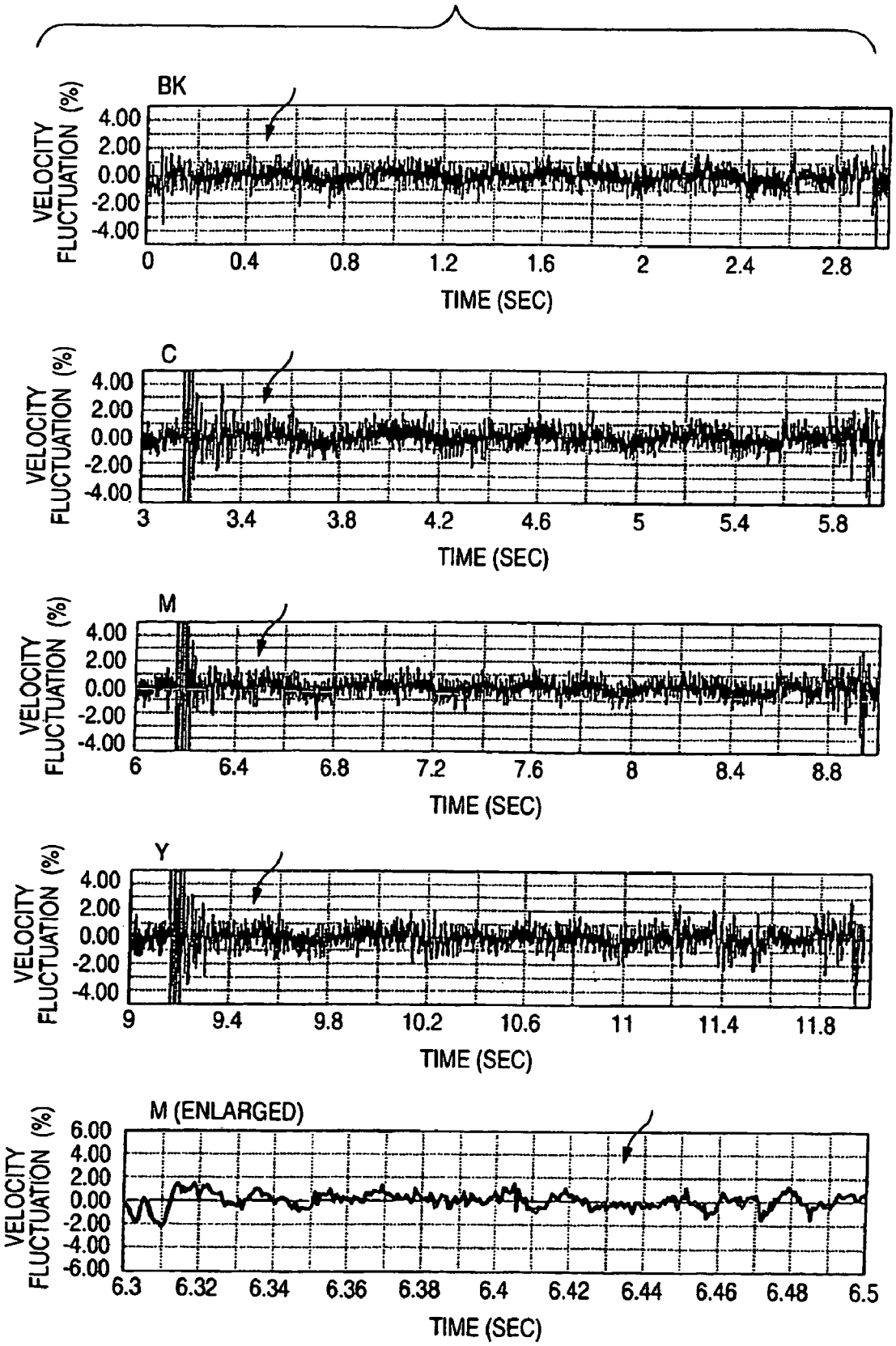
FIG. 29 is experimental data showing elimination of rotation velocity fluctuations by an image forming apparatus according to a seventh embodiment of the invention.

FIG. 29 shows experimental data that the rotation velocity fluctuations of the image carrier 3 are observed under a condition that the circumferential velocities of the image carrier 3 and the intermediate transfer member 12 are substantially equalized at the primary transfer position T1. Arrows designate timings at which the toner line 24 passes through the primary transfer position T1. It is apparent that the rotation velocity fluctuation is eliminated at those timings.

Figure 30:
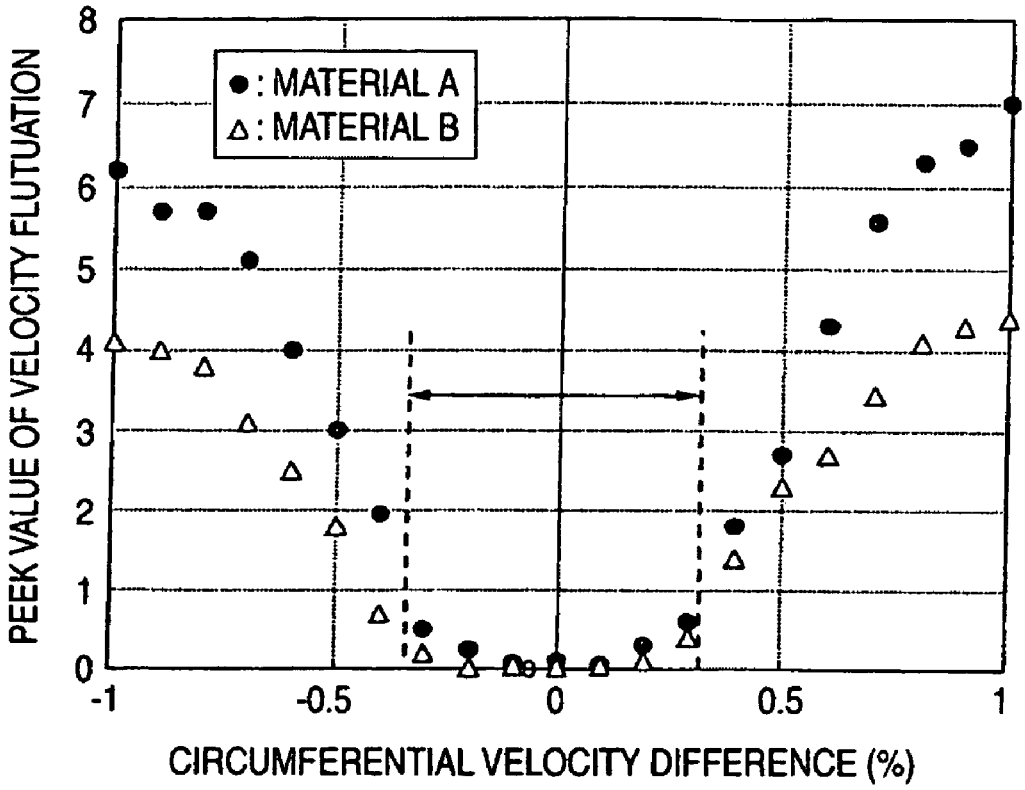
FIG. 30 is experimental data showing a proper range of a circumferential velocity difference between an image carrier and an intermediate transfer member in the image forming apparatus of FIG. 29.

FIG. 30 shows experimental data in which the lateral axis represents values of N/W and the vertical axis represents the peak values of rotation velocity fluctuations of the image carrier 3. The peak value is an average value of five peak values during the image forming operation for magenta. As to the material of the intermediate transfer member 12, the material A is PET coated with conductive material and fluorine contained resin, and the material B includes conductive material and polycarbonate. It is apparent that the rotation velocity fluctuations can be reduced within the range of difference in circumferential velocities of ±0.3%.

Although the electrostatic latent image is formed on the image carrier 3 by the exposer 5 in the above described embodiments, it is also possible to form an electrostatic latent image by a charge injection device. Although the intermediate transfer belt has been described in the above described embodiments, it is also possible to apply it to an intermediate transfer drum, which is defined as the intermediate transfer member in the present invention.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An image forming apparatus, comprising:

a rotary image carrier, on which an electrostatic latent image is formed;

a developer, operable to supply toner onto the image carrier to make the latent image visible as a toner image;

an intermediate transfer member, adapted to temporarily hold the toner image thereon; and a first transferer, which presses the intermediate transfer member against the image carrier to define a primary transfer position therebetween, so that the toner image on the image carrier is transferred to the intermediate transfer member;

a first member, operable to separably come in contact with either the intermediate transfer member or the image carrier; and a controller, operable to start forming the latent image after a predetermined time period elapses since at least one of a first position in a first region of the intermediate transfer member and a second region on the image carrier corresponding to the first region has passed through the primary transfer position, wherein:

the first region is not adapted to receive, from the image carrier, the toner image to be transferred to the recording medium; and the first position is either a position to which the first member comes in contact or a position from which the first member is separated.

2. The image forming apparatus as set forth in claim 1, wherein a circumferential velocity of the image carrier and a circumferential velocity of the intermediate transfer member are different at the primary transfer position.

3. The image forming apparatus as set forth in claim 2, wherein the image carrier and the intermediate transfer member are driven by a common drive source.

4. The image forming apparatus as set forth in claim 1, wherein the first member is a secondary transferer operable to transfer the toner image held on the intermediate transfer member to a recording medium.

5. The image forming apparatus as set forth in claim 1, wherein the first member is a developing roller operable to supply toner to the image carrier.

6. The image forming apparatus as set forth in claim 1, wherein the first member is a cleaner, operable to remove toner remaining on the intermediate transfer member.

7. The image forming apparatus as set forth in claim 6, wherein:

the cleaner is a blade member;

the first transferer applies a bias voltage to the intermediate transfer member; and a nip width formed between the intermediate transfer member and the image carrier at the primary transfer position is larger than a thickness of the blade member.

8. The image forming apparatus as set forth in claim 7, wherein the nip width is two to fifth times of the thickness.

9. The image forming apparatus as set forth in claim 6, wherein:

the cleaner is a brush member;

the first transferer applies a bias voltage to the intermediate transfer member; and a nip width formed between the intermediate transfer member and the image carrier at the primary transfer position is larger than a circumferential length of a contact area between the brush member and the intermediate transfer member.

10. The image forming apparatus as set forth in claim 9, wherein the nip width is two to fifth times of the circumferential length.

11. The image forming apparatus as set forth in claim 1, wherein the first member is a cleaner, operable to remove toner remaining on the image carrier.

12. The image forming apparatus as set forth in claim 1, further comprising a charger, operable to uniformly charge a surface of the image carrier before the latent image is formed, wherein:

the controller is operable to start forming the latent image after a predetermined time period elapses since a second position on the image carrier has passed through the primary transfer position; and the second position is either a position at which the charger starts charging or a position at which the charger stops charging.

13. An image forming apparatus, comprising:

a rotary image carrier, on which an electrostatic latent image is formed;

a developer, comprising at least one developing roller, through which a bias voltage is applied to supply toner onto the image carrier to make the latent image visible as a toner image;

an intermediate transfer member, adapted to temporarily hold the toner image;

a transferer, which presses the intermediate transfer member against the image carrier to define a primary transfer position therebetween, so that the toner image on the image carrier is transferred to the intermediate transfer member; and a controller, operable to start forming the latent image after a predetermined time period elapses since a portion on the image carrier to which the bias voltage is initially applied has passed through the primary transfer position.

14. The image forming apparatus as set forth in claim 13, wherein a circumferential velocity of the image carrier and a circumferential velocity of the intermediate transfer member are different at the primary transfer position.

15. The image forming apparatus as set forth in claim 14, wherein the image carrier and the intermediate transfer member are driven by a common drive source.

16. The image forming apparatus as set forth in claim 13, further comprising a blade member, separatably abutted on the intermediate transfer member to remove toner remaining thereon, wherein:

the transferer applies a bias voltage to the intermediate transfer member; and a nip width formed between the intermediate transfer member and the image carrier at the primary transfer position is larger than a thickness of the blade member.

17. The image forming apparatus as set forth in claim 16, wherein the nip width is two to fifth times of the thickness.

18. The image forming apparatus as set forth in claim 13, further comprising a brush member, separatably abutted on the intermediate transfer member to remove toner remaining thereon, wherein:

the transferer applies a bias voltage to the intermediate transfer member; and a nip width formed between the intermediate transfer member and the image carrier at the primary transfer position is larger than a circumferential length of a contact area between the brush member and the intermediate transfer member.

19. The image forming apparatus as set forth in claim 18, wherein the nip width is two to fifth times of the circumferential length.

* * * * *